US011585201B2

(12) United States Patent
Campbell et al.

(10) Patent No.: US 11,585,201 B2
(45) Date of Patent: Feb. 21, 2023

(54) ALL-IN-ONE SYSTEM AND RELATED METHOD FOR FRACKING AND COMPLETING A WELL WHICH AUTOMATICALLY INSTALLS SAND SCREENS FOR SAND CONTROL IMMEDIATELY AFTER FRACKING

(71) Applicant: SC ASSET CORPORATION, Calgary (CA)

(72) Inventors: Sean P. Campbell, Calgary (CA); Daniel Rojas, Richmond, TX (US); David Speller, Houston, TX (US)

(73) Assignee: SC ASSET CORPORATION, Calgary (CA)

( * ) Notice: Subject to any disclaimer, the term of this patent is extended or adjusted under 35 U.S.C. 154(b) by 0 days.

(21) Appl. No.: 17/737,780

(22) Filed: May 5, 2022

(65) Prior Publication Data

US 2022/0290546 A1 Sep. 15, 2022

Related U.S. Application Data

(62) Division of application No. 17/202,211, filed on Mar. 15, 2021, now Pat. No. 11,459,867.

(51) Int. Cl.
*E21B 43/26* (2006.01)
*E21B 43/10* (2006.01)
(Continued)

(52) U.S. Cl.
CPC ..... *E21B 43/267* (2013.01); *E21B 43/025* (2013.01); *E21B 43/08* (2013.01); *E21B 43/10* (2013.01)

(58) Field of Classification Search
CPC ..... E21B 34/14; E21B 43/26; E21B 43/08; E21B 2200/06; E21B 43/10; E21B 34/12; E21B 34/063; E21B 33/12; E21B 34/08
See application file for complete search history.

(56) References Cited

U.S. PATENT DOCUMENTS 9,976,394 B1 5/2018 Campbell et al.
10,648,285 B2 5/2020 Gaudette et al.
(Continued)

FOREIGN PATENT DOCUMENTS

CA 2899990 A1 * 10/2014 ..... E21B 34/06
CA 3057652 A1 * 6/2019 ..... E21B 34/14

*Primary Examiner* — Zakiya W Bates
(74) *Attorney, Agent, or Firm* — Gowling WLG (Canada) LLP

(57) ABSTRACT

A method for fracking a hydrocarbon formation. An actuating member, flowable along a production string, is provided. A unique key portion thereon engages a desired sliding sleeve covering an associated port in the production string. Applying uphole fluid pressure causes the sliding sleeve and actuating member to move so as to uncover the associated port. After fracking and cessation of supply of pressurized fracturing fluid, a compressed spring on the actuating member decompresses so as to reposition a sand screen immediately beneath the port so as to prevent sand from flowing into the production string. Flowable insertion of additional "keyed" actuating members allows similar opening of additional successive uphole ports and fracking in the regions of such additional opened ports, with similar location of sand screens at each opened port. Plug members on each actuating member thereafter dissolve or are successively burst to thereby allow production.

12 Claims, 13 Drawing Sheets

(51) Int. Cl.

| | |
|---|---|
| ***E21B 43/08*** | (2006.01) |
| ***E21B 43/02*** | (2006.01) |
| ***E21B 43/267*** | (2006.01) |

(56) References Cited

U.S. PATENT DOCUMENTS

| | | | | |
|---|---|---|---|---|
| 2014/0034308 | A1* | 2/2014 | Holderman ..... | E21B 43/12<br>166/279 |
| 2016/0108711 | A1 | 4/2016 | Lynk | |
| 2018/0320488 | A1 | 11/2018 | Campbell et al. | |
| 2019/0353005 | A1 | 11/2019 | Gaudette et al. | |

* cited by examiner

ALL-IN-ONE SYSTEM AND RELATED METHOD FOR FRACKING AND COMPLETING A WELL WHICH AUTOMATICALLY INSTALLS SAND SCREENS FOR SAND CONTROL IMMEDIATELY AFTER FRACKING

CROSS-REFERENCE TO RELATED APPLICATIONS

This application is a divisional of U.S. patent application Ser. No. 17/202,211 filed on Mar. 15, 2021.

FIELD OF THE INVENTION

The present invention relates to a system and method for fracking a hydrocarbon formation and completing a well for production, and more particularly relates to a system and method which immediately after completion of fracking automatically locates a sand screen at an opened port in a production string to prevent ingress of sand from the hydrocarbon formation to allow of subsequent immediate production.

BACKGROUND OF THE INVENTION AND DESCRIPTION OF THE PRIOR ART

After an oil or gas well is drilled within an underground hydrocarbon formation, the well and zones of interest need to be completed prior to production commencing.

Part of the completion process typically firstly includes a fracking operation.

Fracking involves injection of high pressure fluids (namely incompressible liquids, often containing proppants) into the hydrocarbon formation/reservoir to initiate fractures within the surrounding rock to increase porosity of "tight" formations and thereby increase the ability of hydrocarbons within the formation to flow from within a hydrocarbon formation.

Fracking operations for completing a well within a reservoir may increase production from the well by many multiples in a given time period, in some cases up to 3× or greater if conducted over the entire length of a horizontal wellbore as compared to what would otherwise have been the case if a fracking operation had not been completed.

Accordingly, the fracking process can be a very important and critical step in preparing a wellbore for production.

It is important, however, to be able to both frac and further complete a wellbore and ready the well for production as quickly and efficiently as possible, with as little expense in doing so as possible.

As set out further herein, various prior art downhole tools and systems exist and have been used to stimulate wells by permitting treatment/fracturing in multiple contiguous regions within a hydrocarbon formation.

Fracking fluid may contain various adjuvants such as acids and/or diluents to increase followability of the oil/gas from the formation. In addition, however, fracking fluids commonly contain proppants such as fine sand (frac sand) or ceramic beads of consistent and engineered uniform diameter to uniformly "prop" open the created fractures and maintain such fractures in the formation so that hydrocarbons may better flow from the formation.

As explained below, the introduction of large quantities of frac sand into a formation during the fracking process typically results in significant quantities of frac sand being entrained in the oil or gas which flows back into the wellbore for pumping to surface when oil is produced through opened frac ports in a wellbore. Due to the abrasive nature of sand, deleterious and negative results occur during production, including additional increased and heavy wear on pump components within the well, greatly shortening pump life. Downhole pumps, and even downhole pumps most resistive to sand abrasion such as progressive cavity pumps, are typically expensive. Having to frequently replace such pumps results in increased costs not only in the replacing/refurbishing the pump and its components, but further in service rig time and costs in having to "trip out" of a well a downhole pump and "run back in" the production string with a new pump, to say nothing of the lost production and profits due to the well being "off line" during the time of such repairs.

Sand screens are known in the art, and are typically inserted within a production string, typically after the tripping out of the frac string from the well, when a production string having a sand screen covering open ports on such production string is then separately "run in" into the wellbore.

Disadvantageously, however, the aforesaid two-step process having to frac, then trip out the frac string, and then run in a production string with pre-installed sand screens thereon results in considerable additional time and expense in tripping out the frac string, and thereafter running in the production string with elongate cylindrical screens installed thereon.

There is also an inherent risk of damaging the screens during "run in" of the production string in the wellbore.

A more efficient system which allows not only fracking, but further installs sand screens without having to trip out a frac string, has been recognized as beneficial to the wellbore completion industry.

For example, U.S. Pat. No. 9,976,394 along with US 20180320488 each entitled "System and Methods for Fracking and Completing a Well which Flowably Installs Sand Screens for Sand Control", each commonly invented with the within application and commonly assigned to the present applicant, both disclose use of actuating members to selectively engage a respective desired sleeve covering associated ports along the production string. Thereafter, under influence of uphole-applied pressure, the actuating members cause such respective sleeves to be slidably moved downhole to expose an open port in the production string. Fracking fluid is then injected in the production string to frac the formation in the region of the opened port(s). After fracking of the formation in the region at the location of the opened port (s), flowable sand screen subs are thereafter flowed downhole to cover the respective opened port(s) and thereby prevent sand from flowing into the opened port(s) and allow only hydrocarbons from the formation to flow into the production string via the opened port(s).

Disadvantageously, however, such above system and method of U.S. Pat. No. 9,976,394 et. al. requires two (2) members to be flowed downhole for each port to be fracked, namely a first actuating member flowed downhole to selectively engage the sleeve covering the respective port to slidably move such sleeve downhole under uphole-applied hydraulic pressure to thereby open the respective port, and another (second) flowable member having a sand screen thereon to likewise be flowed downhole and fixedly located in the production string at the region of the opened port to thereafter screen sand from entering the wellbore via the opened port when fracking has ceased and the production string is receiving hydrocarbons via the opened port and such hydrocarbons are thereafter being pumped to surface.

Similarly, US 2019/0353005 (now U.S. Pat. No. 10,648,285) entitled "Fracturing System and Method" to Baker Hughes teaches a fracturing sleeve having both an opening sleeve and a closing sleeve, which as disclosed and as shown in FIG. 2A-2B (item 44) and col. 2 line includes a sand screen spaced from the opening sleeve and disposed in the same zone as the opening sleeve, which may be subsequently actuated via a pumpable actuating member to cause a screen to be slid over an opened port for sand control. Similar to U.S. Pat. No. 9,976,394 and disadvantageously, the system of U.S. Pat. No. 10,648,285 requires two (2) actuation members to flowed downhole to frac and complete a single port—a first actuating member to actuate and move the opening sleeve which is initially covering the port to an open position to thereby expose (open) the desired port, and after completion of fracking via the opened port, a second (larger) actuating member is further required to be flowed downhole to slidably position a closing sleeve having the sand screen thereon over the opened port. Again, as in U.S. Pat. No. 9,976,394, two (2) actuating members need to be flowed downhole which not only consume time, but add additional cost.

Numerous other designs exist for moving a sliding sleeve so as to open a port and thereafter to cover the port, but do not provide for sand control or provision of screens.

As one example, US 2016/0108711 entitled "Sliding Sleeve for Stimulating a Horizontal Wellbore, and Method for Completing a Wellbore", in inter alia FIGS. 5A-5H, discloses use of an actuating member in the form of a flowable fracturing ball 530 which when flowed downhole in a production string is used to slidably re-position an aperture 525 into alignment with a port 545 on the production string to thereby open the port to allow fracking. Additional applied up-hole pressure on the slidable sleeve and fracturing ball 530 causes further displacement of the slidable sleeve downhole, thereby moving the aperture 525 from alignment and thereby closing port 545, to then allow further opening of ports downhole, and further fracking downhole. Thereafter, after completion of fracking, the casing 610 needs to be perforated proximate each of sleeves 500A-500H (ref. page 11, para. [0194].

While problems of "screen-out" are mentioned in US 2016/01088711 [a condition where continued injection of fluid inside the fracture requires pressures in excess of the safe limitations of the wellbore or wellhead equipment—"screen-out" occurs when the proppant (sand or other solids) in the fracture fluid being injected into the formation restricts flow within the wellbore or into the perforations], there is no teaching or suggestion whatsoever in US 2016/01088711 of use of sand screen screens to cover new apertures created in casing 610 in the region of sleeves 500A-500H, nor is there any disclosure or suggestion of how a sand screen could be incorporated into the apparatus.

Accordingly, a need exists for a less time-consuming, least costly, but yet efficient system and method for both fracking and completing wells, which provides a less expensive and less time-consuming method. Specifically, there exists a need for an "all-in-one" well fracking and completion system which allows flowing into a tubular string one actuating member per port which is fracked, which allows not only fracking of the reservoir at the given port but further without pulling the tubular string automatically installs a sand screen and thus be able to immediately thereafter produce from such port.

SUMMARY OF THE INVENTION

It is an object of the invention that a tubular string used for fracking need not be "tripped out" after a fracking step in order to complete the well and allow production from the well after fracking operations.

It is a further object of the present invention that sand from a hydrocarbon formation containing oil sand as well as additional sand resulting from conducting a fracking operation be substantially prevented from entering a wellbore during production operations and otherwise detrimentally affecting pumping equipment, to say nothing of increased costs of disposing of such sand.

It is a further object of the invention to provide a system and method which reduces instances of damage being inflicted to sand screens when they are positioned within a wellbore downhole.

It is a still further object to be able to immediately after fracking, provide sand screens at the locations of the frac ports, to immediately thereafter prevent, as much as possible, the ingress of sand into the wellbore and the deleterious results which occur therefrom.

It is a further object of the invention to avoid having to flow downhole a plurality of actuation members for each port to be fracked, and to be able to use only one actuation member for each port.

Reference herein and below to "uphole" and "downhole" with regard to a particular component of the system, or with respect to the method of the present invention, is a reference to a location on the component within a wellbore where uphole means in the direction of the surface along a wellbore, and "downhole" is the correspondingly opposite direction towards a toe of the wellbore.

Reference to the term "unique profile" herein shall be construed as including, but not limited to, a unique longitudinal width dimension.

Accordingly, in order to meet some or all of the above objects and advantages, in a first broad embodiment the present invention comprises a system for fracking a hydrocarbon formation at a given location along a wellbore, comprising;

a tubular liner insertable within said wellbore, said tubular liner having an interior bore and further comprising:

(a) a plurality of longitudinally spaced-apart frac ports, spaced at longitudinal intervals along the tubular liner, providing, when open, fluid communication between the interior bore of the tubular liner and an exterior of the tubular liner;

(b) a plurality of cylindrical hollow sliding sleeve members within said interior bore, each configured when in an initial closed position to cover a corresponding of said longitudinally spaced-apart frac ports at each spaced interval along said tubular liner and prevent flow of fluid through said frac ports, each slidably moveable longitudinally in the interior bore to an open position to uncover a corresponding of the frac ports, each of the sliding sleeve members having an interior circumferential groove of a unique profile or of a unique longitudinal width; and (c) a plurality of shear members, initially securing respectively said slidable sleeve members to the tubular liner in said initial closed position, and sheareable when a longitudinal force is applied to thereafter allow longitudinal slidable movement of respective of said slidable sleeve members;

at least one hollow substantially cylindrical actuation member insertable within said tubular liner, comprising:

(i) an elongate substantially cylindrical hollow collet sleeve, having a radially-outwardly biased protuberance on a periphery thereof having a first unique profile, said radially-outwardly biased protuberance configured to matingly engage said interior circumferential groove or profile on a corresponding one of the plurality of sliding sleeve members;

(ii) a dissolvable or burstable plug member, which for a limited time or up to a specified pressure, prevents pressurized fluid injected downhole in said interior bore from travelling through said actuation member thereby allowing said actuation member to be forcibly flowed downhole in said tubular liner by said pressurized fluid;

(iii) a longitudinally-extending sand screen member, longitudinally slidably moveable along said cylindrical actuation member and of a longitudinal length sufficient to cover said frac port when slidably positioned beneath said frac port, adapted to prevent ingress of sand but permit ingress of oil into a hollow interior of said cylindrical actuation member;

(iv) a spring member, situated adjacent to said sand screen member, adapted to be forcibly compressed by said sand screen member when pressurized fluid is applied to an uphole end of said cylindrical actuation member and to be decompressed upon removal of pressurized fluid and thereafter longitudinally slidably reposition said sand screen member within said tubular liner;

wherein when said cylindrical actuation member having said unique profile thereon has been flowed downhole in said tubular liner by pressurized fluid and has selectively engaged said desired sliding sleeve member having a corresponding unique profile thereon and caused said sliding sleeve to move downhole so as to open said frac port, said spring member is compressed so as to permit said sand screen member to be longitudinally positioned within said tubular member so as not to cover said opened frac port thereby allowing unobstructed flow of said pressurized fluid through said frac port; and wherein when said pressurized fluid is ceased being applied to said actuation member, said spring member immediately decompresses and slidably moves said sand screen member longitudinally within said tubular liner to a location beneath and covering at least a portion of said opened frac port.

Advantageously, the above system provides for the immediate installation of a sand screen at such given location of an opened port without having to "trip out" a frac string prior to commencing production at such location, and further provides for the use of only one actuation member, and not having to flow downhole a second member having a sand screen thereon.

In a refinement of such first broad aspect, each of the sliding sleeve members are configured so as to lockingly engage the tubular liner when the respective sliding sleeve members are each respectively moved so as to uncover a corresponding frac port. In such manner the sliding sleeve members, once in said open position, are thereby prevented from thereafter inadvertently returning to a closed position and covering the opened port in the tubing liner. Absence of this feature would mean that the slidable sleeve could potentially close, thus preventing oil from being produced from such (now closed) port along the tubular liner. It is contemplated in a preferred embodiment that the locking engagement comprise mating engagement means on both the sliding sleeve members and on the tubular members.

Accordingly, in a preferred, non-limiting embodiment, the mating engagement means on the sliding sleeve members comprise a plurality of collet fingers, radially outwardly biased, and extending from a downhole end of each sliding sleeve member, and the corresponding mating engagement means on the tubular liner comprises an annular circumferential ring on the tubular liner, which when one of said slidable sleeve members is caused to be moved to the open position, the radially outwardly-biased collet fingers, and in particular protuberances on respective distal ends of such collet fingers, matingly engage said annular circumferential ring on said sliding sleeve member so as to lockingly engage and secure the sliding sleeve member in the open positon to the tubular string. Other manners of providing mating engagement of each sliding sleeve with the tubular liner will now be apparent to persons of skill in the art and are specifically contemplated as part of the within invention.

In a further particular refinement, the unique profile of the radially-outwardly biased protuberance on the actuation member is of a unique width W1, and the interior circumferential groove on the mating sliding sleeve is of a width equal to or greater than W1.

Thus in a still-further refinement, the system for fracking and completing a well in a hydrocarbon formation of the present invention further comprises:

a second actuation member, insertable within the interior bore of the tubular liner, comprising:

(I) an elongate substantially cylindrical hollow collet sleeve, having a radially-outwardly biased protuberance on a periphery thereof having a second unique profile of width W2 where W2<W1, where the radially-outwardly biased protuberance is configured to matingly engage the interior circumferential groove or profile on another of the plurality of sliding sleeve members and is of a width equal to or greater than W2 but less than W1;

(II) a dissolvable or burstable plug member, which for a limited time when exposed to dissolving fluid or up to a specified pressure, prevents pressurized fluid injected downhole in said tubular string from travelling through the actuation member, thereby allowing the second actuation member to be forcibly flowed downhole in the tubular liner by the pressurized fluid;

(III) a longitudinally-extending sand screen member, longitudinally slidably moveable along the cylindrical actuation member and of a longitudinal length sufficient to cover said frac port when slidably positioned beneath said frac port, configured to prevent ingress of sand but permit ingress of oil into a hollow interior of the cylindrical actuation member; and (IV) a spring member, situated adjacent to said sand screen member, adapted to be forcibly compressed by said sand screen member when pressurized fluid is applied to an uphole end of the cylindrical actuation member and to be decompressed upon removal of pressurized fluid and to then longitudinally slidably reposition the sand screen member within said tubular liner;

wherein when the cylindrical actuation member having said unique profile thereon has been flowed downhole in the tubular liner by pressurized fluid and has selectively engaged the desired sliding sleeve member having a corresponding unique profile thereon and caused the sliding sleeve to move downhole so as to open the associated frac port, the spring member on the actuation member is compressed so as to permit the sand screen member to be longitudinally positioned along said actuation member in a region within said tubular member so as not to cover the opened frac port, thereby allowing unobstructed flow of said pressurized fluid through said frac port during a fracking operation; and wherein when the pressurized fluid is ceased being applied to the actuation member, the spring member is configured to be immediately decompressed and slidably move the sand screen member longitudinally within said tubular liner to a location beneath and covering at least a portion of said opened frac port.

In a preferred or additional refinement, the radially-outwardly biased protuberance on the actuation member may be configured such that after matingly engaging the interior circumferential groove or profile on the respective sliding sleeve member it remains lockingly engaged with the interior circumferential groove or profile on said slidable sleeve. Thus advantageously, the actuation member is prevented from further movement within said tubular liner, and thus the sand screen thereon remains fixed in the open position with the associated frac port and all oil flowing into the tubular liner via such port will necessarily be required to pass through such sand screen.

In a further or alternative refinement of the first broad embodiment, the dissolvable or burstable plug member is a dissolvable plug member which is dissolvable upon a dissolving fluid being provided to the interior bore of the tubular liner. The dissolvable plug member may further comprise a dissolvable ball which may be flowed downhole in the tubular liner, and which after being exposed to a dissolving fluid, after a passage of time dissolves so as to allow flow of bitumen along the tubular string. Composition of balls which may dissolve in time, and corresponding fluid which may cause such dissolution, are well known to persons of skill in the art, and are thus not further discussed in detail herein.

In a further refinement, the cylindrical actuation member further comprises a seating surface, configured to provide a sealing surface against which said dissolvable or burstable plug member may abut, which sealing surface in combination with said plug member, at least for a limited time, prevents pressurized fluid from travelling through said actuation member.

In another broad aspect of the system of the present invention, such invention comprises a cylindrical actuation member, insertable within a tubular liner for use when fracking a hydrocarbon formation at a given location along the tubular liner, which after opening a port and after a fracking step, immediately locates a sand screen member at said location without having to "trip out" a frac string prior to commencing production, comprising:

(i) an elongate substantially cylindrical hollow collet sleeve, having a radially-outwardly biased protuberance on a periphery thereof having a unique profile, said radially-outwardly biased protuberance configured to matingly engage an interior circumferential groove on a corresponding one of a plurality of sliding sleeve members within said tubular liner;

(ii) a seating surface, configured to provide a sealing surface against which a dissolvable or burstable plug member may abut, which sealing surface in combination with a plug member, at least for a limited time, prevents pressurized from travelling through the actuation member;

(iii) a longitudinally-extending sand screen member, longitudinally slidably moveable along the cylindrical actuation member, adapted to substantially prevent passage of sand therethrough but substantially permit passage of bitumen or oil therethrough; and (iv) a spring member, situated adjacent to and downhole of the sand screen member, adapted to be forcibly compressed by the sand screen member when pressurized fluid is applied to an uphole end of said cylindrical actuation member and to be decompressed upon removal of pressurized fluid against said cylindrical actuation member and to thereafter longitudinally reposition the screen member in an uphole direction.

In a still-further broad aspect of the present invention, the present invention comprises a method for conducting a fracking procedure at a given location along a wellbore. Such method advantageously locates a sand screen at such location immediately after a fracking step at such location is completed, thereby immediately preventing ingress of any sand into said tubular liner and allowing subsequent production from the formation without having to first "trip out" any frac string insert a production string in order to commence production.

Such method comprises the steps of:

(i) locating a tubular liner having:
- a hollow interior bore;
- a plurality of frac ports longitudinally spaced along said tubular liner;
- a corresponding plurality of sliding sleeve members initially covering corresponding of each of said frac ports;

within a wellbore in a hydrocarbon formation;

(ii) situating a first substantially cylindrical actuation member having a radially outwardly-biased protuberance thereon with a unique profile within said tubular liner;

(iii) applying a pressurized fluid to an uphole end of said first actuation member having a plug member in the form of a dissolving member or a burstable disk, and causing said first actuation member flow downhole and to a position in said tubular liner where said radially outwardly-biased protuberance thereon engages a corresponding mating profile on one of said plurality of sliding sleeve members;

(iv) continuing to apply said pressurized fluid to said first actuation member in said tubular liner and causing said one sliding sleeve member and first actuation member engaged therewith to then together move downhole and uncover and thereby open an associated of said plurality of frac ports in said tubular liner and thereby allow fluid communication from said hollow interior bore to an exterior of said tubular liner and to said hydrocarbon formation via the opened associated frac port;

(v) injecting a fracking fluid under pressure into said tubular liner and causing said fracking fluid to flow into the hydrocarbon formation via the opened frac port; and (vi) ceasing supply of said fracking fluid under pressure, so as to cause a spring member on said first actuation member to be decompressed and thereby reposition a sand screen member on said first actuation member to a position covering at least a portion of said opened associated frac port such that hydrocarbons flowing form the hydrocarbon formation through said opened frac port into said hollow interior bore of said tubular liner pass through said sand screen member.

In a refinement of such method, the plug member on said actuation member is a burstable disk and such method further comprises the step, after step (v), of injecting a pressurized fluid into said interior bore at a pressure sufficient to rupture said burstable disk, so as to thereafter allow fluid to flow through said first actuation member. This advantageously then allows oil which has flowed into the tubular string after fracking through the opened port to thereafter be pumped to surface.

Where the plug member is a dissolvable member, the method further comprises the step, after step (v), of injecting a dissolving fluid or using said frac fluid if said frac fluid is a dissolving fluid, to dissolve said dissolvable member so as to thereafter allow fluid to flow through said first actuation member.

In a preferred embodiment of the above method, such method further comprises the step when said first actuation member engages the corresponding sliding sleeve member and moves such sliding sleeve member to the open position, of causing the sliding sleeve member when at said open position to lockingly engage the tubular liner. This feature thereby advantageously allows the sliding sleeve member and associated frac port within the tubular liner to be maintained in an open state to ensure production may continue through such opened frac port.

In such preferred embodiment, the step of causing said one of said sliding sleeve members when at said open position to lockingly engage said tubular liner comprises the step, of causing a biased protuberance on said sliding sleeve member to engage a mating groove in said tubular member so as to retain said first sliding sleeve member in a position where the respective associated frac port is uncovered.

Alternatively, the said step of causing said one of said sliding sleeve members when moved to said open position to lockingly engage said tubular liner comprises the step of causing a ratchet member on said sliding sleeve to engage a mating ratchet member on said tubular liner, so as retain said one of said sliding sleeve members in a position where the respective associated frac port is uncovered and return movement of the sliding sleeve in an uphole direction is thereby prevented.

In a further preferred embodiment of the above method, a shear pin is provided to initially maintain each sliding sleeve initially covering an associated port, so that during insertion of a tubular liner into a well bore any detritus or tailings remaining from drilling the wellbore, or any sand or obstructive material, will be prevented from entering the wellbore. Accordingly, in a preferred embodiment, step (iv) of the above method of causing said one sliding sleeve member and first actuation member engaged therewith to together move downhole and uncover and thereby open an associated of said plurality of frac ports further comprises the step of using such applied pressurized fluid to cause a shear pin fixing said sliding sleeve within said tubular liner to shear so as to then allow said one sliding sleeve member and first actuation member engaged therewith to together move downhole within said tubular liner and uncover and thereby open an associated of said plurality of frac ports.

In a still further embodiment of the above method, when said first actuation member engages said one sliding sleeve member and moves said sliding sleeve member to the open position, the first actuation member may further be caused to lockingly engage the sliding sleeve member, thereby preventing further movement of said actuation member relative to said one of said sliding sleeve members. This advantageously allows for each actuation member used to be fixed in position and evenly distributed along the tubular liner, and each engaged with a respective sliding sleeve.

In a preferred embodiment of the aforesaid method, such method further comprises the steps, after step (vi), of:

(vii) situating a second substantially cylindrical actuation member having a resiliently outwardly-biased protuberance thereon with a unique profile, within said tubular liner;

(viii) applying a pressurized fluid to an uphole end of said second actuation member having a plug member thereon in the form of a dissolving member or a burstable disk, and causing said second actuation member to flow downhole and to a position in said tubular liner where said radially outwardly-biased protuberance thereon engages a corresponding mating profile on one of said plurality of sliding sleeve members;

(ix) continuing to apply said pressurized fluid to said first actuation member in said tubular liner and causing said one sliding sleeve member and said second actuation member engaged therewith to then together move downhole and uncover and thereby open an associated of said plurality of frac ports in said tubular liner to thereby allow fluid communication from said hollow interior bore to an exterior of said tubular liner and to said hydrocarbon formation via the opened associated frac port;

(x) injecting a fracking fluid under pressure into said tubular liner and causing said fracking fluid to flow into the hydrocarbon formation via the opened frac port; and (xi) ceasing supply of said fracking fluid under pressure, so as to cause a spring member on said second actuation member to be decompressed and thereby reposition a sand screen member on said second actuation member to a position covering at least a portion of said opened associated frac port such that hydrocarbons flowing form the hydrocarbon formation through said opened frac port into said hollow interior bore of said tubular liner must pass through said sand screen member.

In other words, it is contemplated that the method of the present invention be repeated for each port located along the tubular string, and thus the method of the present invention further comprises repeating steps (i)-(v) using a second, third, and consecutive cylindrical actuating members, each having a unique profile mating with a similar unique interior circumferential groove or grooves on the interior of each sliding sleeve, until all of said plurality of spaced-apart ports along the tubular liner have been uncovered, the wellbore fracked at each opened frac port and a sand screen situated at each opened frac port.

Typically, the most-distal port along the wellbore from surface will be opened first by a first actuation member, and the formation fracked at such location and a sand screen installed, and thereafter the second actuating member will be targeted to the second—lowermost (second most distal) port, and the sequence repeated for each successive port and corresponding sliding sleeve, until the entirety of wellbore has been fracked along its entire length, and sand screens installed at each port after fracking.

In one embodiment the unique profile may vary uniquely in terms of the relative width of the protuberance(s) on the actuating member and the corresponding width of the circumferential groove (s) on the interior of the various sliding sleeves. Thus pairs of mating profiles may be a series of protuberances and circumferential interior mating grooves, each of varying widths and/or spacing relative to other pairs of actuating members and sliding sleeves, to provide unique engagement of one actuating member with a unique sliding sleeve to open a port at a desired length along.

In a further refinement, the radially-outwardly biased protuberance of said first actuation member is of a width W1, and said resiliently-outwardly biased protuberance of said second actuation member is of a width W2, wherein W2<W1.

BRIEF DESCRIPTION OF THE DRAWINGS

Further advantages and permutations and combinations of the invention will now appear from the above and from the following detailed description of various particular embodiments of the invention, taken together with the accompanying drawings each of which are intended to be non-limiting, in which:

FIG. 2A-2E are a series of sequential cross-sectional sections of a production tubing string, showing the various sequential positions of a sliding sleeve in the region of a port on such tubing string, prior to, during insertion of, and after actuation by an activation member, further showing the manner of selective engagement of a unique profile on the actuation member with the particular desired sliding sleeve, and which sliding sleeve uses a ratcheting mechanism to retain the sliding sleeve in the open position once actuated to such position by the actuation member, wherein:

FIG. 2A is an enlarged cross-sectional view of the tubing liner, associated port and sliding sleeve of area 'A' of FIG. 1 prior to flowable insertion into the tubing liner of an actuating member and prior to the sliding sleeve being moved downhole;

FIG. 2B is an enlarged similar cross-sectional view of the tubing liner, associated port and sliding sleeve shown of area 'A' of FIG. 1, after a first actuating member has been flowed downhole in the tubing liner and lockingly engaged the sliding sleeve covering such lowermost (most distal) port in the tubing liner;

FIG. 2C is an enlarged cross-sectional view of the tubing liner, associated port and sliding sleeve was shown in area 'A' of FIG. 1, after a first actuating member has been flowed downhole in the tubing liner, lockingly engaged the sliding sleeve covering such lowermost (most distal) port in the tubing liner, and further has moved the sliding sleeve to a position uncovering the port and thereby opening the port;

FIG. 2D. is an enlarged cross-sectional view of the tubing liner, associated port and sliding sleeve was shown in area 'A' of FIG. 1, after a first actuating member has been flowed downhole in the tubing liner, lockingly engaged the sliding sleeve covering such lowermost (most distal) port in the tubing liner, and further has moved the sliding sleeve to an open position uncovering the port, and fluidic pressure acting on the plug member has been removed and the actuating member via a spring member thereon then slidably positioned a screen underneath the opened port; and FIG. 2E. is an enlarged cross-sectional view of the tubing liner, associated port and sliding sleeve was shown in area 'A' of FIG. 1, after a first actuating member has been flowed downhole in the tubing liner, lockingly engaged the sliding sleeve covering such lowermost (most distal) port in the tubing liner, and further has moved the sliding sleeve to an open position uncovering the port, and fluidic pressure acting on the plug member has been removed, and the actuating member slidably positioned a screen underneath the opened port, and the plug member has been dissolved;

FIG. 3A-3E are a series of enlarged sequential cross-sectional sections of a production tubing string, showing the various sequential positions of a sliding sleeve in only the region of a port on such tubing string, prior to, during insertion of, and after actuation by an activation member, wherein:

FIG. 3A is an enlarged view of the circled area 'r' in FIG. 2A;

FIG. 3B is an enlarged view of the circled area 's' in FIG. 2B;

FIG. 3C is an enlarged view of the circled area 't' in FIG. 2C;

FIG. 3D is an enlarged view of the circled area 'u' in FIG. 2D;

FIG. 3E is an enlarged view of the circled area 'v' in FIG. 2E;

FIG. 4A-4E are a series of sequential partial cross-sectional sections of the same production tubing string, showing the various sequential positions of a sliding sleeve in the region of a port on such tubing string, prior to, during insertion of, and after actuation by an activation member, further showing the manner of selective engagement of a unique profile on the actuation member with the particular desired sliding sleeve, and which uses a ratcheting mechanism to retain the sliding sleeve in the open position once actuated to such position by the actuation member, wherein:

FIG. 4A is a full sectional view of the tubular liner, associated port and sliding sleeve of FIG. 2A, prior to flowable insertion into the tubing liner of an actuating member and prior to the sliding sleeve being moved downhole;

FIG. 4B is a full sectional view of the tubular liner associated port and sliding sleeve of FIG. 2B, showing the actuation member in non-sectional and after such actuating member has been flowed downhole in the tubing liner and lockingly engaged the sliding sleeve covering such lowermost (most distal) port in the tubing liner;

FIG. 4C is a full sectional view of the tubular liner in the area of an associated port and sliding sleeve after flowable insertion of an actuating member and after the actuating member has lockingly engaged the locking sleeve having a similar unique mating profile as the actuating member, and after the sliding sleeve has been repositioned downhole;

FIG. 4D is a full sectional view of the tubular liner in the area of an associated port and sliding sleeve after a first actuating member has been flowed downhole in the tubing liner, lockingly engaged the sliding sleeve covering such lowermost (most distal) port in the tubing liner, and further has moved the sliding sleeve to an open position uncovering the port, and fluidic pressure acting on the plug member has been removed and the actuating member slidably positioned a screen underneath the opened port; and FIG. 4E is a full sectional view of the tubular liner in the area of an associated port and sliding sleeve after a first actuating member has been flowed downhole in the tubing liner, lockingly engaged the sliding sleeve covering such lowermost (most distal) port in the tubing liner, and further has moved the sliding sleeve to an open position uncovering the port, and fluidic pressure acting on the plug member has been removed and the actuating member slidably positioned a screen underneath the opened port, and the plug member has been dissolved;

DETAILED DESCRIPTION OF SOME PREFERRED EMBODIMENTS

Figure 1:
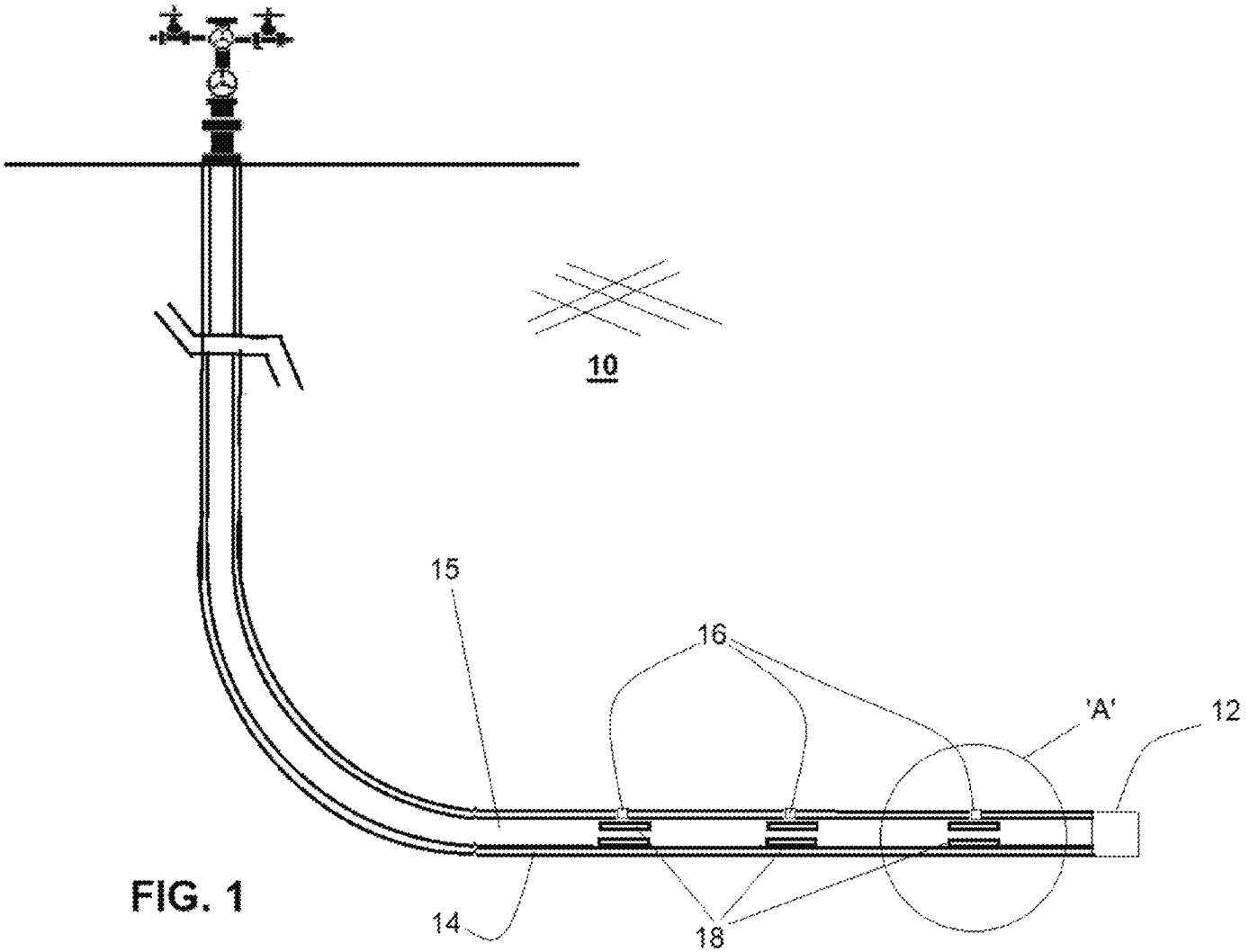
FIG. 1 is a schematic view of a typical wellbore having a tubular liner inserted therein, further having a plurality of ports, with each port having a corresponding sliding sleeve initially covering the associated port.

FIG. 1 is a schematic diagram of a typical wellbore 12 drilled within a hydrocarbon formation 10. A tubular liner 14 with an interior bore 15 is provided within such wellbore 12, with the tubular liner 14 having a plurality of longitudinally-spaced apart frac ports 16 spaced at longitudinal intervals therealong which provide, when open, fluid communication between the interior bore 15 and an exterior of the tubular liner 14.

A plurality of cylindrical hollow sliding sleeve members 18 ("sliding sleeve") are provided within interior bore 15 of and along tubing liner 14, each sliding sleeve 18 configured when in an initial closed position to cover a corresponding of said longitudinally spaced-apart frac ports 16, as shown for example in FIG. 1, 2A, 3A, and FIG. 4A. Each sliding sleeve member 18 is slidably movable longitudinally in the interior bore 15 to an open position to uncover a corresponding frac port 16, as shown for example in FIG. 1, 2C, 3C, and FIG. 4C.

Figures 2A, 2B, 2C, 2D, 2E:
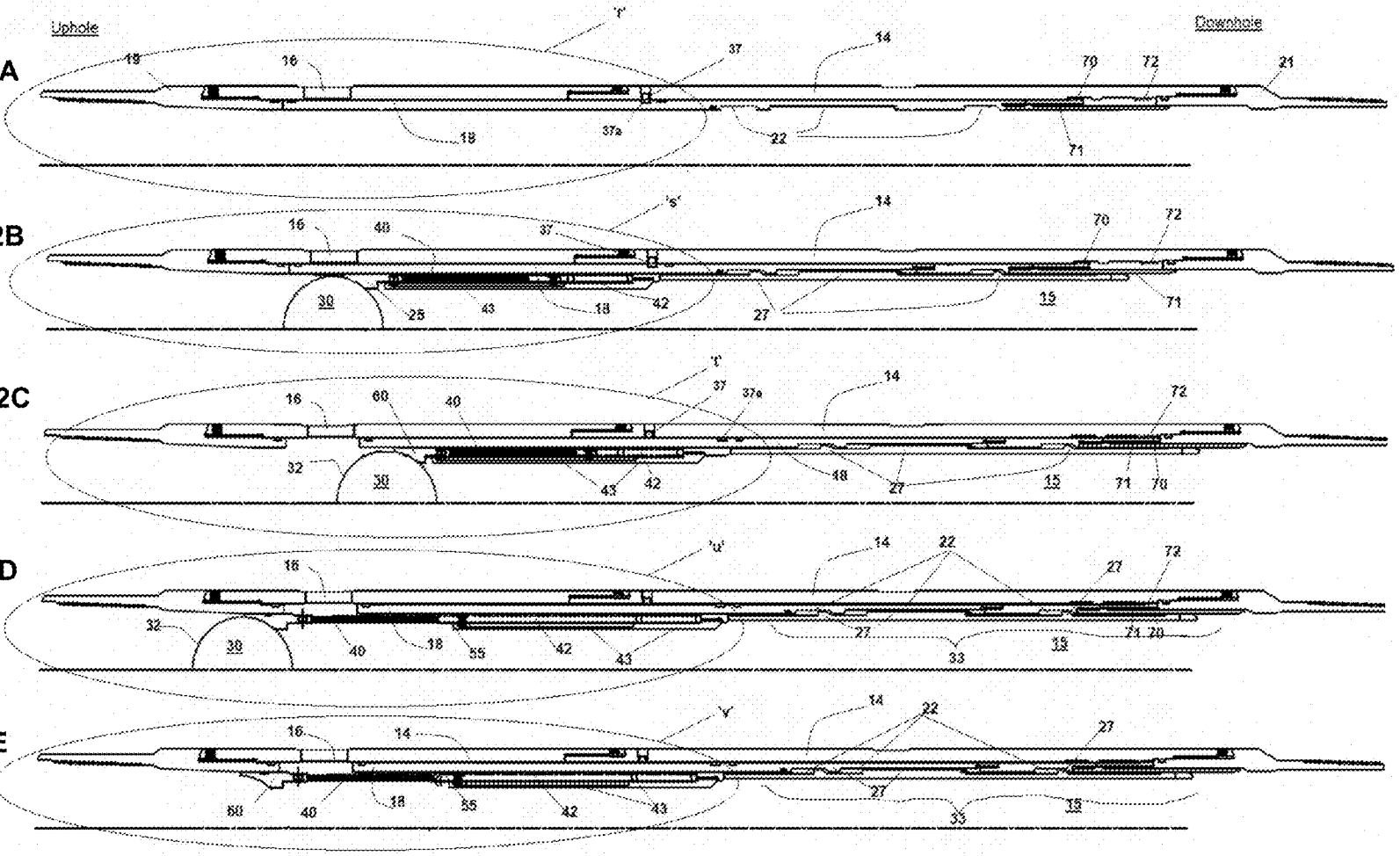
Figures 4A, 4B, 4C, 4D, 4E:
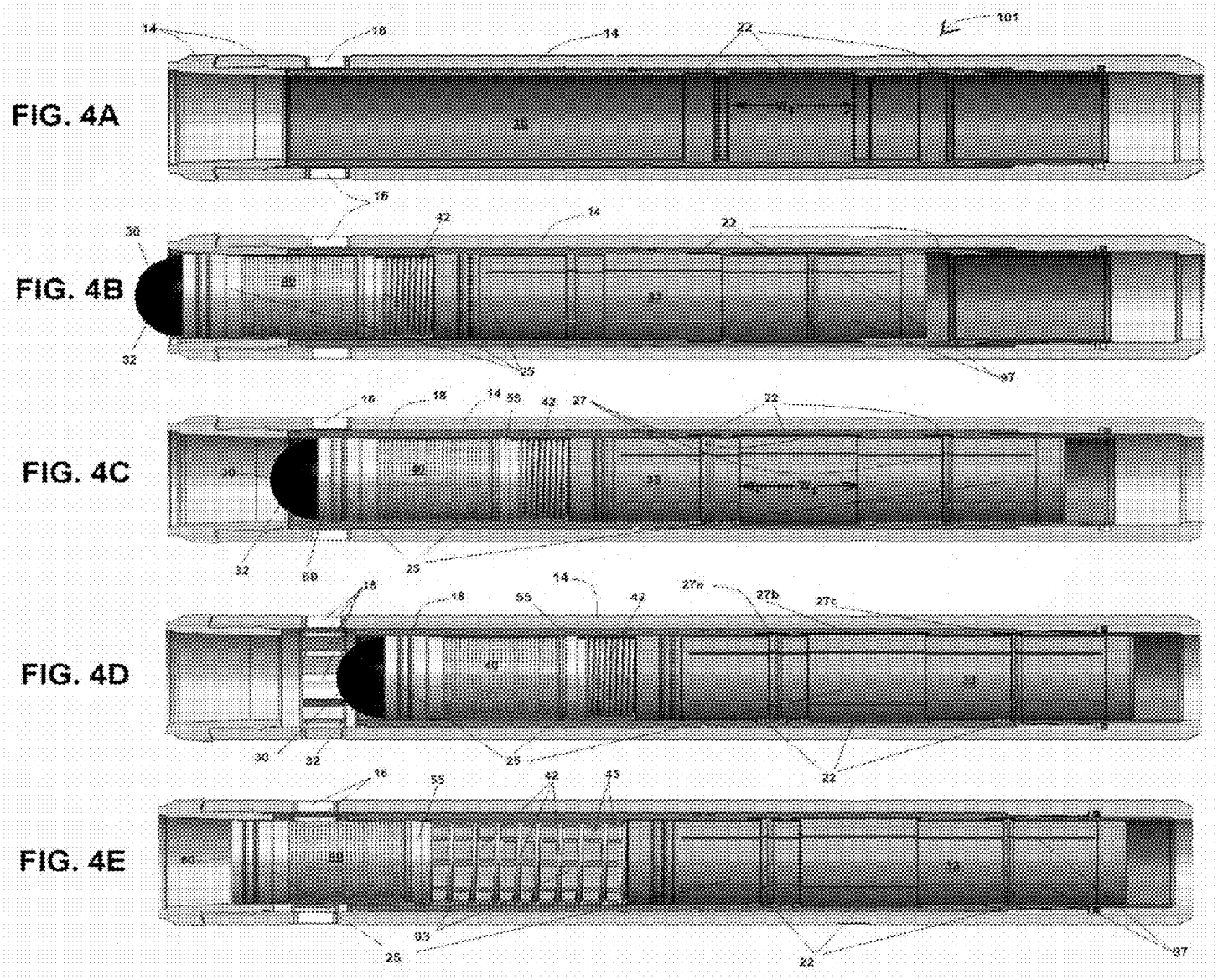

As best seen for example in FIG. 2A and FIG. 4A, each sliding sleeve 18 is provided with an interior circumferential groove or grooves 22 of a unique "key" profile (in this case each groove 22 of a varying width and a varying distance between each groove 22).

Figure 7:
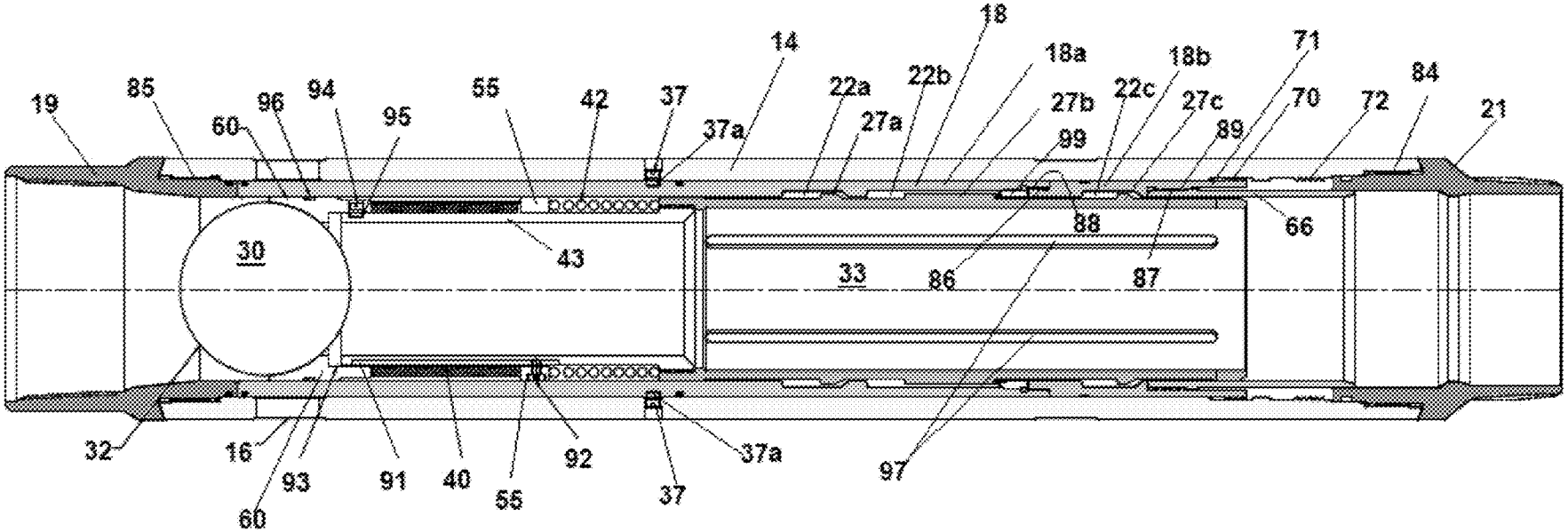
FIG. 7 is an enlarged full cross-sectional view of the tubing liner, associated port and sliding sleeve of the invention shown of area 'A' of FIG. 1, and FIGS. 2B-2E, after a first actuating member has been flowed downhole in the tubing liner and lockingly engaged the sliding sleeve covering such lowermost (most distal) port in the tubing liner, but prior to fluid pressure exerted on the plug member having sheared the shear pins and compressed the spring.

As best seen for example in FIG. 7, each sliding sleeve 18 may comprise a plurality of individual members such as for example individual members 18*a*, 18*b*, which as shown in FIG. 7 are threadably jointed together by mating external threads, such as external threads 86 on individual member 18*b*, and corresponding internal mating threads 88 on individual sliding sleeve member 18*a*.

Configuration of sliding sleeves 18 in such manner wherein they are comprised of a plurality of individual members 18*a*, 18*b* threadably joined together provides the significant advantage of allowing easier and less expensive machining of internal grooves 22*a*, 22*b*, and 22*c* on each of the respective individual members 18*a*, 18*b*, the purpose of such internal grooves 22 (ie. 22*a*, 22*b*, and 22*c*) being more fully explained herein.

As more fully explained below and with reference to applicant's corresponding U.S. Pat. No. 10,563,482 entitled "Profile-Selective Sleeve for Multi-stage Valve Actuation" which is incorporated by reference in its entirety with respect to the manner of using profile selective sleeves and their manner of selective engagement by unique actuation members, by providing sliding sleeves 18 each with an interior circumferential groove or grooves 22 of a unique "key" profile (in this case each groove 22 or series of grooves for example 22*a*, 22*b*, & 22*c*, being of a varying width $W_1$ and a varying longitudinal distance between each groove 22—see for example FIG. 2B and FIG. 4A as well as FIGS. 7-10) and further providing similarly uniquely-keyed actuation members 25 having a similar unique mating profile in the form of a radially-outwardly biased protuberance 27 or protuberances 27*a*, 27*b*, 27*c* on a collet member 33, each of similar varying width and a varying longitudinal distance between each protuberance 27 (ref. for example FIG. 2B, FIG. 4B and FIG. 7 herein), the uniquely-"keyed" actuating member 25 having protuberances 27*a*, 27*b*, 27*c* will selectively matingly engage and only engage with a similar uniquely-"keyed" sliding sleeve 18, having similar sized and spaced internal grooves 22*a*, 22*b*, and 22*c* therein.

After "keyed" engagement of the protuberances 27*a*, 27*b*, and 27*c* of the actuation member 25 with a selected sliding sleeve 18 having therein correspondingly sized and spaced internal grooves 22*a*, 22*b*, and 22*c* and upon application of uphole fluidic pressure to actuation member 25, the particular desired sliding sleeve 18 and actuation member 25 are together caused to be slidably repositioned downhole to thereby uncover and thereby open the associated frac port 16.

As seen for example in FIG. 2A & FIG. 7, an entire production string may comprise a a tubing liner 14 having a series of threadably joined tubing sections 101, with each tubing section 101 having an internally-threaded top sub 19 threadably secured at mating threads 85 to a tubing liner portion 14 at an uphole end thereof, and an externally-threaded bottom sub 21 threadably secured at mating threads 84 to a tubing liner portion 14 at an downhole end thereof.

A plurality of shear members 37 are provided, typically shear pins, with at least one shear member 37 extending through the tubing liner 14 into a threaded aperture 37*a* in each sliding sleeve 18, to initially secure respectively each sliding sleeve 18 to the tubular liner 14 in the initial closed position covering each port, as shown for example in FIGS. 2A & 2B, and 3A & 3C, in order to prevent any tailings or other detritus from entering the tubular liner 14 upon "run in" of such tubular liner 14 into the drilled wellbore. The shear pins 37 shear upon application of a downhole force on the sliding sleeve member 18 after engagement with a unique actuation member 25. Such force is exerted when an actuation member 25 is flowed downhole and then engages a selective sliding sleeve 18, and fluidic pressure applied to an uphole end thereof, as best shown by arrows in FIGS. 3B & 3C, applies a pressure on the actuation member 25, and thus on the sliding sleeve 14 to which it is lockingly engaged.

Figure 6A:
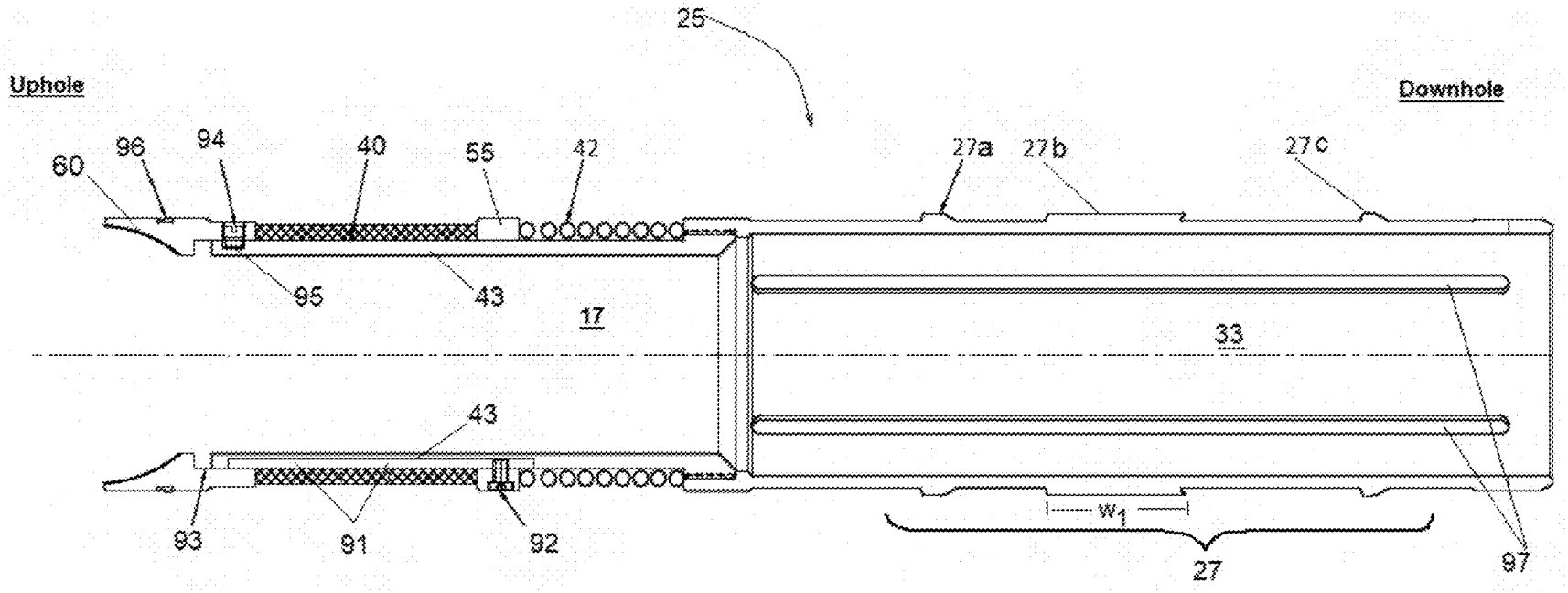
FIG. 6A is a cross-sectional view of the actuation member, being one embodiment of the present invention, immediately prior to being provided with an additional plug member and being flowed downhole.
Figure 6B:
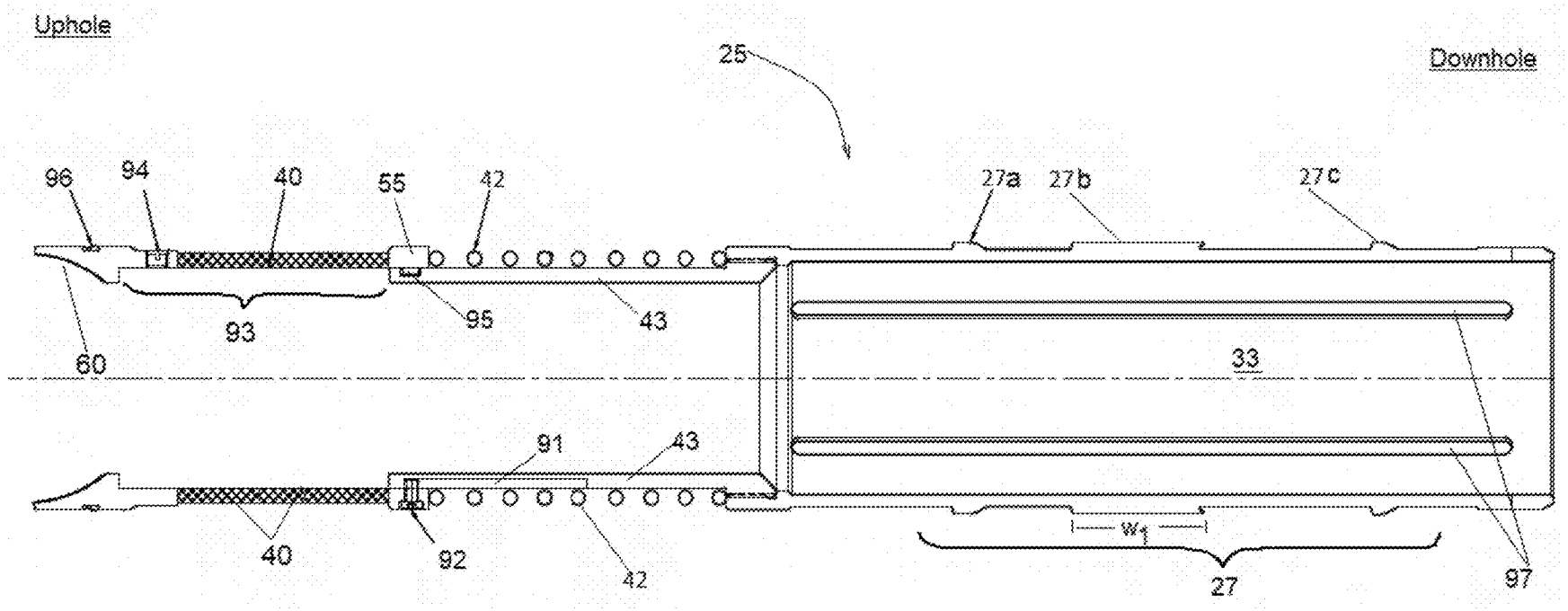
FIG. 6B is a similar cross-sectional view of the actuation member of the present invention, wherein the plug member has dissolved, and the sand screen thereon been extended so as to be deployed in a position within the interior of the tubular string below a desired port therein.

As referenced above, at least one actuation member 25 is provided, as can best be seen in FIGS. 4B, 4C, & 4D, as well as FIGS. 6 A& 6B, to actuate a desired sliding sleeve 18 to an open position to allow injection of fracking fluid via a port 16 at a desired location along the tubular string 14 into the formation, and to further, after completion of fracking, allow inflow of oil into the interior bore 15 of tubing liner 14, for subsequent production to surface. As may be best seen from FIGS. 6A & 6B, as well as from FIGS. 7, 8, 9 & 10, actuation member(s) 25 each comprise: (i) a substantially hollow collet sleeve portion 33; (ii) a longitudinally-extending sand screen member 40; and (iii) a spring member 42.

A plug member 30, which may be a dissolvable plug member 32 such as a dissolvable ball, or alternatively a burstable plug member (not shown), may be flowed into or originally positioned in the actuation member 25, to initially prevent flow of fluids through hollow interior bore 17 of actuation member to allow;

As regards collet sleeve portion 33 of actuation member 25, such collet sleeve portion 33 allows the actuation member 25, when flowed downhole, allows actuation member 25 to selectively engage a desired sliding sleeve 18 along tubing string 14. Collect sleeve portion 33 has at least one radially-outwardly biased protuberance 27 on a periphery thereof having a unique profile for such purpose, which is configured to matingly engage an interior circumferential groove or grooves 22 of similar unique (mating) profile on a corresponding one of the plurality of sliding sleeve members 18, as best shown in FIG. 4C-4E, to allow mating engagement (preferably locking engagement, as more fully set out herein) with a corresponding sliding sleeve 18 having a similar unique profile. Thereafter, fluid pressure exerted in tubing liner 14 on an uphole side of actuation member 25 causes both the actuation member and mated sliding sleeve 18 to be forced downhole, thereby opening respective port 16.

As regards a dissolvable or burstable plug member 30, such plug member 30 (for a limited time in the case of a dissolvable plug, or up to a specified pressure in the case of a burstable plug member) prevents pressurized fluid injected downhole in said interior bore 15 from travelling through said actuation member 25. Such thereby allows actuation member 25 along with engaged respective sliding sleeve 18 to be forcibly flowed downhole in said tubular liner 14 by the pressurized fluid, as shown by arrow in FIG. 3C.

After the supply of a dissolvable fluid which acts on the plug member 30 to cause it after a period of time to dissolve, or where the plug member 30 is a burstable plug (not shown), after the provision of a pressure pulse uphole of the burstable plug causing it to burst, oil which enters interior bore 15 of tubular liner 14 may be freely pumped uphole.

As regards longitudinally-extending sand screen member 40 forming part of actuating member 25, such sand screen member 40 as best seen in FIGS. 4B-4E, is longitudinally slidably moveable along said cylindrical actuation member 25, and is of a longitudinal length sufficient to cover said frac port 16 when slidably positioned beneath it, as shown for example in FIG. 4E.

As may be best seen from FIGS. 4B-4E, sand screen 40 comprises a perforated screen having a series of apertures therein, and is typically a stainless steel or galvanized member where the apertures therein are of a small enough dimension/diameter to prevent ingress of sand into interior bore 15 but of sufficient diameter to permit ingress of oil into the interior bore 15 of both actuation member 25 and tubing liner 14 to allow such oil to thereafter be pumped or flowed to surface via tubing liner 14. Screen 40 may be attached to and abut a sealing surface member 56 at its uphole end, and be attached or abut, via a coupling member 55, spring 42 at and along its downhole end.

As regards spring member 42 forming part of actuating member 25, spring member 42 is in a preferred embodiment a helical coil spring, as best shown in FIGS. 4B-4E. Coil spring 42 may be positioned over/around a collet member 43, and is slidably moverable along collet 43 to permit its compression and decompression. A helical coil spring 42 is situated adjacent to said sand screen member 40, on a downhole side thereof. Coil spring 42 may thus be forcibly compressed by said sand screen member 40 when screen support assembly 43 is forced downhole by fluid pressure applied to an uphole end of actuation member 25, particularly when actuation member 25 and corresponding engaged sliding sleeve 18 are together engaged and further moved to the end of their permitted travel in tubing liner 14, as shown in FIG. 2C, FIG. 3C, & FIG. 4C, whereupon spring 42 is fully compressed.

Figures 3A, 3B, 3C, 3D, 3E:
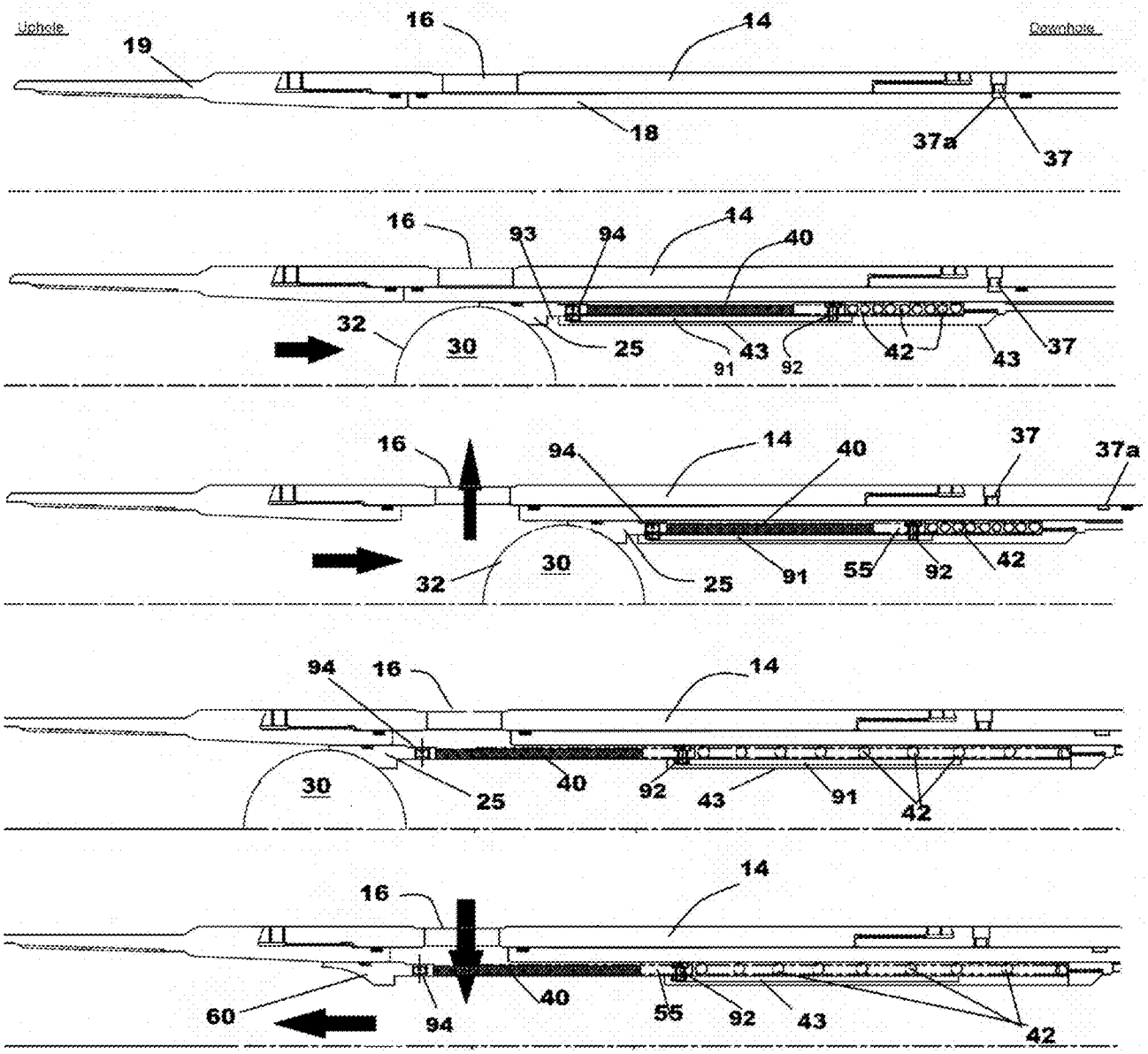

Upon cessation of supply of pressurized fluid to an uphole end of actuation member 25 and plug member 30, spring 42 decompresses and slidably repositions sand screen member 40 in an uphole direction so as to position at least a portion of sand screen member 40 of immediately beneath port 16, as best shown in FIGS. 2E, 3E, & 4E.

As noted above, each of said sliding sleeve members 18 and the tubular liner 14 at a location proximate each of said frac ports 16 have mating engagement means which become respectively lockingly engaged when said sliding sleeve members 18 are each respectively moved so as to uncover a corresponding frac port 16. In a preferred embodiment, and as best seen in FIGS. 2A-2C, such mating engagement means in one embodiment comprises, on sliding sleeve 18, a series of toothed ratchets 70 on collet sleeve 71, which when sliding sleeve 18 is repositioned downhole by actuation member 25 (see FIG. 2C), are caused to slide over and engage toothed ratchets 72 on tubular liner 14, thereafter keeping sliding sleeve in the new position in tubular liner 14 and preventing sliding sleeve 18 from ever again moving uphole so to cover port 16. The toothed ratchets 70,72 when engaged with each other thereby retain the sliding sleeve members 18, once in the open position, from thereafter returning to a closed position to cover corresponding frac port 16.

As best shown in FIGS. 5A-5E, the mating engagement means on the sliding sleeve members 14 may alternatively comprise a plurality of collet fingers 71 having protuberances 80 thereon (in place of toothed ratchets 70) which are radially outwardly biased, and extending from a downhole end of each sliding sleeve member 18. The corresponding mating engagement means on the tubular liner 14 may in such embodiment alternatively may comprise an annular circumferential ring 82 on the tubular liner 14, which when one of said slidable sleeve members 18 travel to the open position, protuberances 80 lockingly engage annular circumferential ring on tubular liner 14, thereby lockingly retaining sliding sleeve member 18 in locking engagement with tubular liner 14 and thus the corresponding port 16 in an open position. Mandrel 66 having external threads 87 thereon, may be threadably secured via internal threads 89 on individual member 18*b* to individual member 18*b* forming collet sleeve 71. Mandrel 66 serves to reduce and prevent ingress of sand or detritus into an area proximate ratchets 70 and 72 which could otherwise prevent their engagement, as shown for example in FIG. 7, or alternatively where radially-outwardly biased protuberances 80 are provided on collet fingers 71 to engage grooves 82 as shown in FIGS. 5A-5E, to likewise prevent or reduce ingress of sand in groove 82 which could otherwise prevent locking engagement of protuberances 80 with internal grooves 82.

In the embodiments shown and as best seen in FIG. 4D, the profile for the radially-outwardly biased protuberance 27*b* (and particularly where only one radially-outwardly biased protuberance 27*b* is used on actuation member 25 instead of three, namely 27*a*, 27*b*, 27*c* uniquely spaced between themselves), such radially-outwardly biased protuberance 27*b* on said actuation member 25 is of a width W1, and the corresponding interior circumferential groove 22 on sliding sleeve member 18 is of a width equal to or greater than W1, as shown, to thereby permit mating engagement therebetween. However, where additional actuation members 25 are employed to open additional successively-more-uphole sliding sleeves 18 covering other additional corresponding uphole ports 16 along tubular liner 14, the width of each protuberance 27*b* on each successively employed actuation member 25, namely widths W2, W3, W4, will each be less than width W1, such that W1>W2>W3>W4 etc, and the same applies to the associated width of mating annular groove 22 in each of progressively-more-uphole sliding sleeves 18 in tubing liner 14.

This configuration, whereby the width of the protuberance 27*b* on successive actuation members 25 and the width of annular grooves 22 on the tubular liner 14 in the region of progressively more uphole ports successively lessens thus ensures that successively-inserted actuation members 25, each with successively lesser widths of protuberance 27*b*, will successively engage and open each of progressively more uphole sliding sleeves 14.

Thus in a further refinement of the present invention, a second, third, fourth and potentially additional actuation members 25', 25", 25'" and 25"", etc., may be similarly utilized, where each are identical to actuation member 25 save and except for a different mating profile such as but not limited to, a progressively lesser width W2, W3, W4, and W5 on the respective collet sleeve portion 33 additional actuation members 25', 25", 25'" and 25"", etc, may be used to successively engage and open progressively more uphole sliding sleeves 18 to successively expose ports 16, frac the formation in such region through the opened port, and thereafter immediately install sand screens 40 after completion of the fracking step for each of the respective ports 16.

Again, in such an embodiment, for each successive actuation member 25', 25", 25'" and 25"", etc., the radially-outwardly biased protuberance 27*b* on the respective actuation member is configured such that after matingly engaging the interior circumferential groove or profile 22 on the corresponding sliding sleeve member 18, such radially-outwardly biased protuberance on the respective actuation member 25', 25", 25'" and 25"", etc remains lockingly engaged with the interior circumferential groove or profile 22 on the slidable sleeve 18, and the respective actuation member is thereby prevented from further movement within sliding sleeve 18.

Similarly, for each of the associated sliding sleeve members sleeve members 18 and the tubular liner 14 at a location proximate each of said frac ports 16, each have mating engagement means which become respectively lockingly engaged when said sliding sleeve members 18 are each respectively moved so as to uncover a corresponding frac port 16.

Such mating/locking engagement means may take the form, as shown for example in FIGS. 2A-2E, of toothed ratchets 70 on collet fingers 71 of sliding sleeves 18, which engage respective toothed ratchets 72 on tubular liners 14 in the region of the associated port 16 when the sliding sleeve is moved to its most downhole position uncovering the associated port 16. Alternatively, as shown in FIGS. 5A-5E, such mating/locking engagement means may take the form of one or more radially-outwardly based protuberances 80 on collet fingers 71, which matingly engage annular rings 82 on tubular liners 14 in the region of the associated port 16.

Figures 5A, 5B, 5C, 5D, 5E:
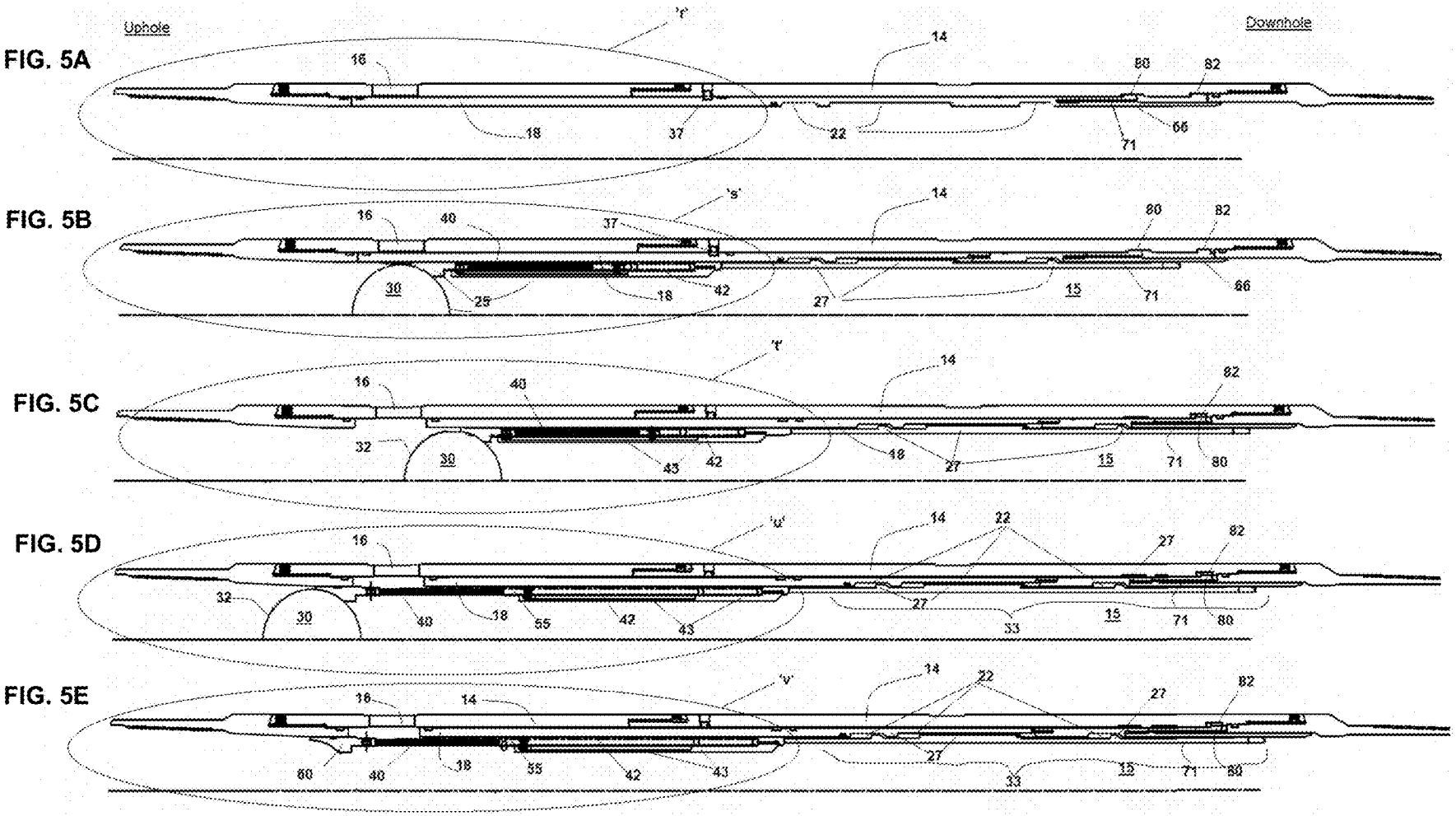
FIGS. 5A-5E are sequential cross-sectional views of another fracking system of the present invention similar to the fracking system as shown in FIG. 2A-2E, showing the various sequential positions of a sliding sleeve in the region of a port on such tubing string, prior to, during insertion of, and after actuation by an activation member, further showing the manner of selective engagement of a unique profile on the actuation member with the particular desired sliding sleeve, but with an alternative different configuration for keeping the sliding sleeve in locking engagement with the tubular liner not employing a ratchet mechanism but rather the engagement of a mating protuberance.

In one embodiment, where the plug member is dissolvable ball 32, and as best seen in FIGS. 2E, 3E, and 5E, the actuation member 25 may be provided with a seating surface 60, configured to provide a sealing surface against which said dissolvable or burstable plug member 30 may abut, which sealing surface 60 in combination with the plug member 30, at least for a limited time, prevents pressurized from travelling through the actuation member, at least until the actuation member 25 has opened the port, and the fracking operation been completed through the opened port.

FIG. 6A shows one embodiment of the actuation member 25 of the present invention, immediately prior to insertion downhole in a tubing string 14.

In the embodiment shown (ie. immediately prior to being provided with an additional plug member 30 and being flowed downhole), the uphole end thereof is provided with a seating surface 60 to allow the seating of a plug member 30 therewithin, namely a dissolvable ball 32. Dissolvable ball 32 may be flowed downhole by fluid pressure, and caused to seat in seating surface 60, thereby preventing, along with o-ring seals 96 located on seating surface 60, any subsequent passage of fluid past actuation member 25 and thereby and causing dissolvable ball 32 and actuation member 25 to be together flowed downhole.

Alternatively, in place of seating surface 60 the actuation member 25 may have a plug member 30 in the form of a burstable disk (not shown), which, up to a given fluid pressure applied uphole of actuation member 25, resists passage of fluid through bore 17.

Upon uphole fluid pressure exceeding a certain pressure, for example immediately subsequent to supplying pressurized fracking fluid through ports 16, a short high fluid pressure pulse may be provided to burst the burstable disk (not shown) to thereafter allow flow of fluid, including produced oil, through internal bore of actuation member 25.

On actuation member 25 a collet sleeve 33 is provided at the downhole side thereof. Collet sleeve 33 has a series of longitudinal slots 97 therein, to allow resilient flexing of raised protuberances 27*a*, 27*b*, and 27*c*.

Specifically, exterior periphery of collet sleeve 33 possesses a unique profile 27, comprising one or more resiliently-flexible raised protuberances 27*a*, 27*b*, and 27*c*, each of unique widths and spacing relative to similar protuberances on other actuation members 25 used for actuating and uniquely engaging other sliding sleeves 18 located along tubing liner 14. For example, the longitudinal width W1 of raised protuberance 27*b* may be of a unique and different width W1 which is different that a width W2 of a corresponding raised protuberance 27*b* on another actuation member 25, to thereby allow each actuation member to selectively engage a corresponding groove 22*b* of similar unique width within a sliding sleeve 18.

A screen support assembly 43 is threadably secured to an uphole end of collet member 33 of actuation member 25. Screen support assembly 43 has mounted on the outer periphery thereof a coil spring 42, which is initially secured on screen support in a compressed state. A ring member 55 allows a guide pin/stop member 92 therein to slidably move in longitudinal channel 91 within screen support assembly 43.

A cylindrical sand screen 40 is further provided, which circumferentially surrounds screen support assembly 43 and is located thereon between seating surface 60 and ring member 55. Seating surface 60 is initially secured to screen support assembly 43 by shear screws 94 which are threadably inserted and extend into threaded apertures 95 in screen support assembly 43. Means (not shown) may further be provided to retain seating surface 60 attached to screen support assembly 43 after shear screws 94 have been sheared, to prevent seating member 60 inadvertently being flowed uphole and covering an opened port 16.

A gap/space 93 is further provided between the uphole end of screen support assembly 43 and seating surface 60, to allow movement downhole of seating surface member 60 upon application of uphole fluidic pressure when a ball 30 is used as the plug member to thereby allow shearing of shear screws 95. Upon shearing of shear screws 95, an uphole force exerted by compressed coil spring 42 is then able to cause desired uphole displacement of sand screen member 40, ring member 55, and seating surface 60.

FIG. 6B shows actuation member 25 and the position of sand screen member 40 after shear screws 95 have sheared. As may be seen, after shear screws 95 have been sheared (i.e. after application of a high pressure pulse of fluid to an uphole end of actuation member 25 when the later is engaged with a corresponding sliding sleeve 18 each have together moved downhole to uncover a corresponding port 16, and after fracking of the formation through the opened port 16), the restriction posed by shear screws 95 in preventing compressed coil spring 42 from forcing sand screen, seating surface 60, and ring member 55 is thereby removed. Accordingly, coil spring 42 decompresses and in doing so longitudinally extends so as to force sand screen 40 longitudinally uphole, to the position shown in FIG. 6B. Gap 93 between seating surface 60 and screen support assembly 43 is now significantly greater, as shown in FIG. 6B compared to FIG. 6A.

FIGS. 7-11 show successive stages in one method of the present invention, using the configuration of components as described above and shown in FIGS. 2A-2E, 3A-3E, and FIG. 4A-4E, and FIG. 6A.

Specifically, FIG. 7 is an enlarged full cross-sectional view of the tubing liner 14, associated port 16 and sliding sleeve 18. Sliding sleeve 18 in the embodiment shown is comprised of two individual members 18*a* and 18*b*, the latter forming a collet sleeve 71 having ratchet 70 thereon. FIG. 7 depicts such components after a first actuating member 25 has been flowed downhole in tubing liner 14 along with a dissolving ball 32 and protuberances 27*a*, 27*b*, and 27*c* thereon have lockingly engages the corresponding mating apertures 22*a*, 22*b*, and 22*c* in sliding sleeve 18 covering such lowermost (most distal) port 16 in the tubing liner.

As may be best seen in FIG. 7, in order to assist in ensuring locking engagement of radial protuberances 27*a*, 27*b*, 27*c* on collet portion 33 of actuation member 25 with internal corresponding mating grooves 22*a*, 22*b*, and 22*c* on selected sliding sleeve 18, a hardened metal annular ring 99 may further be threadably secured to the inner circumference of sliding sleeve 18 in the region of grooves 22*a*, 22*b*, and/or 22*c* (in this case shown, on the downhole edge of groove 22*b*), in order to provide a hardened surface to better prevent any inadvertent movement downhole of actuation member 25 upon application of uphole applied fluidic pressure when fracking the formation 10 via the opened port 16. Details as to the configuration of such hardened annular ring member 99 are further disclosed in US Pub 2020/0182015 co-owned with the present invention.

Figure 8:
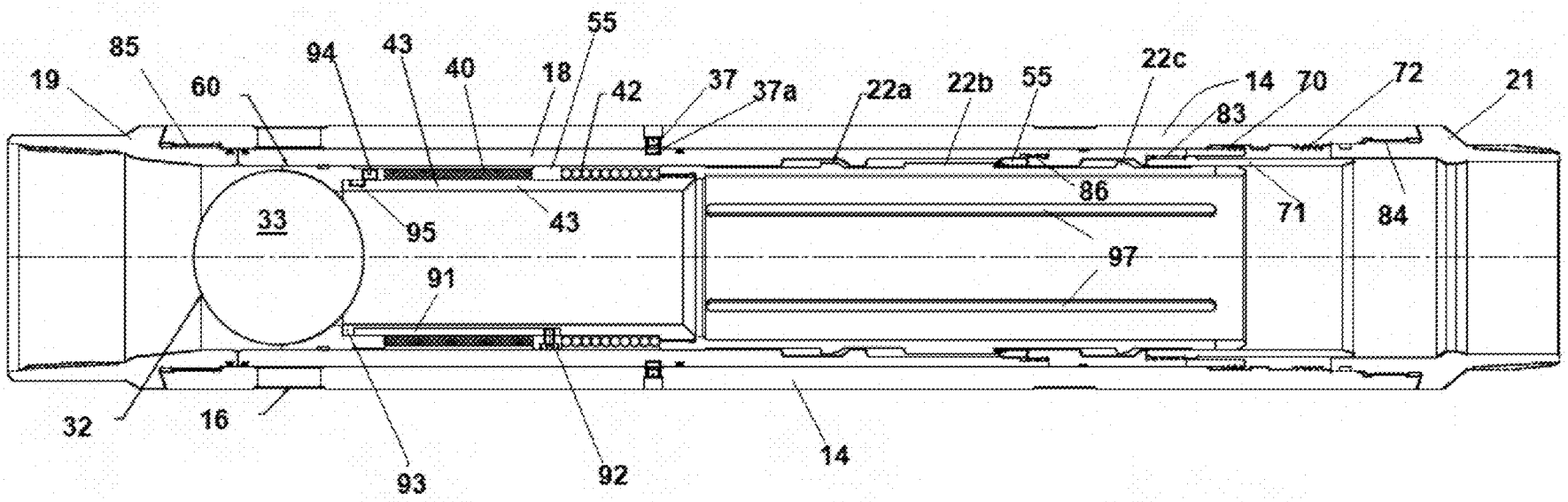
FIG. 8 is a view of the tubing liner, associated port and sliding sleeve shown of FIG. 7, immediately after uphole fluid pressure exerted on the plug member has caused the shear pins securing the sand screen to the actuation member to be sheared and the spring become further compressed (even though the port has been partially opened)

FIG. 8 is a view of the tubing liner 14, associated port 16 and sliding sleeve 18 shown in FIG. 7, immediately after uphole fluid pressure exerted on the plug member 30 has caused the shear pins 94 securing the sand screen 40 to the screen support assembly 43 to be sheared and the helical coil spring 42 as a result become further compressed due to downward pressure thereon.

As may be seen in FIG. 8, due to applied uphole fluid pressure, after locking engagement of actuation member 25 with grooves 22*a*, 22*b*, and 22*c* on the desired sliding sleeve 18 shear pins 95 having sheared, further compressing on of helical coil spring 42. At this juncture in the sequence of the method of the present invention shear pins 37, due to the applied uphole fluidic pressure, have not as yet been sheared to allow sliding sleeve 18 to be move downhole to uncover port 16.

Figure 9:
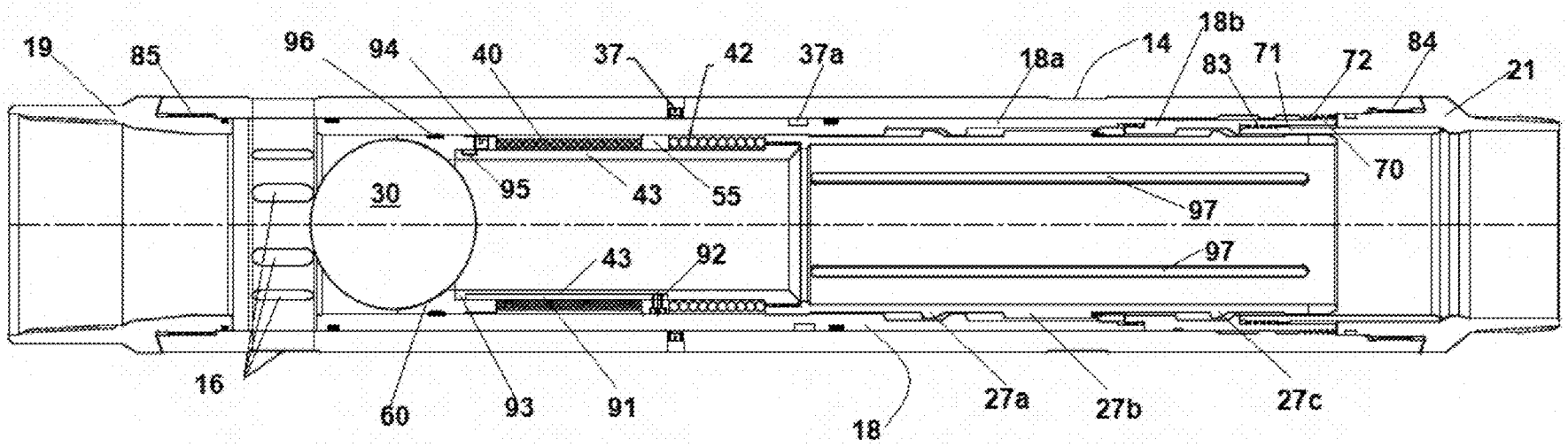
FIG. 9 is a subsequent view of the tubing liner, associated port and sliding sleeve shown in FIG. 8, after fluid uphole pressure has further caused the actuation member engaged with the sliding sleeve to move downhole to fully open the port, and the ratchet member on the sliding sleeve engaged the ratchet member on the tubing string thereby preventing further return uphole of the sliding sleeve.
Figure 10:
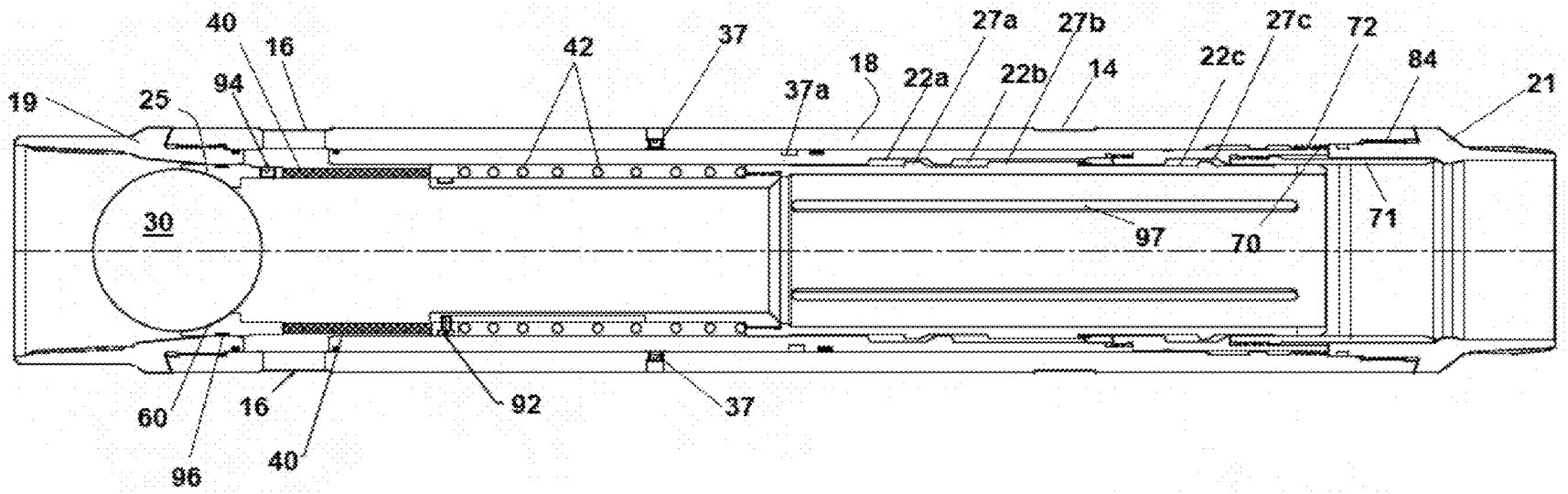
FIG. 10 is a subsequent view of the tubing liner, associated port and sliding sleeve shown in FIG. 9, after uphole fluid pressure has further ceased or been substantially reduced, and the spring on the actuation member caused the sand screen on the actuation member to be re-located uphole so as to have at least a portion of the sand screen situated substantially underneath and disposed below the opened port.

FIG. 9 is a subsequent view of the tubing liner 14, associated port 16 and sliding sleeve shown in FIG. 8, after fluid uphole pressure has now further caused shear pins 37 to become sheared, thereby allowing actuation member 25 engaged with the sliding sleeve 18 to move downhole to fully open the port 16, and the ratchet member 70 on collet sleeve 71 forming part of individual member 18*b* now engaged ratchet member 72 on the tubing string 14 thereby preventing further return uphole of the sliding sleeve 18 and actuation member 25 engaged thereto;

FIG. 10 is a subsequent view of the tubing liner 14, associated port 16 and sliding sleeve 18 shown in FIG. 9, after uphole fluid pressure has further ceased or been substantially reduced, and helical coil spring 42 spring on the actuation member 25 caused the sand screen 40 to be re-located uphole so as to have at least a portion of the sand screen 40 situated substantially underneath and disposed below the opened port 16.

Figure 11:
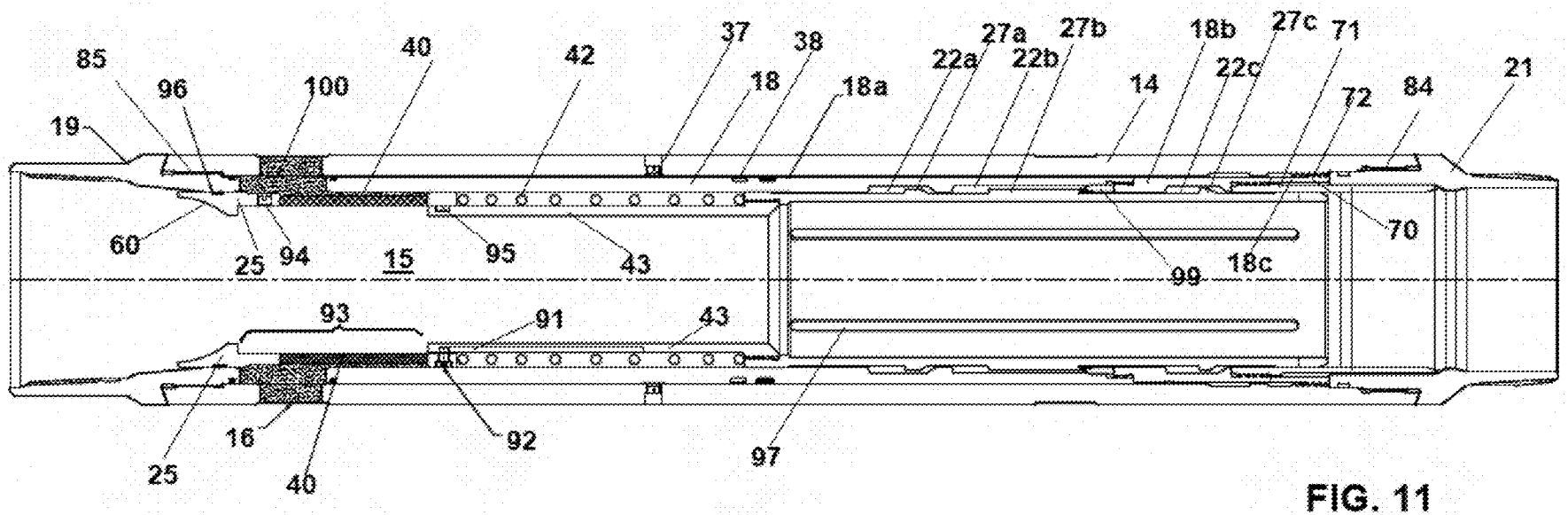
FIG. 11 is a subsequent view of the tubing liner, associated port and sliding sleeve shown in FIG. 10 after sand has flowed into the opened port but not been allowed, due to the sand screen, to flow into the interior bore of the tubing liner.
Figure 12:
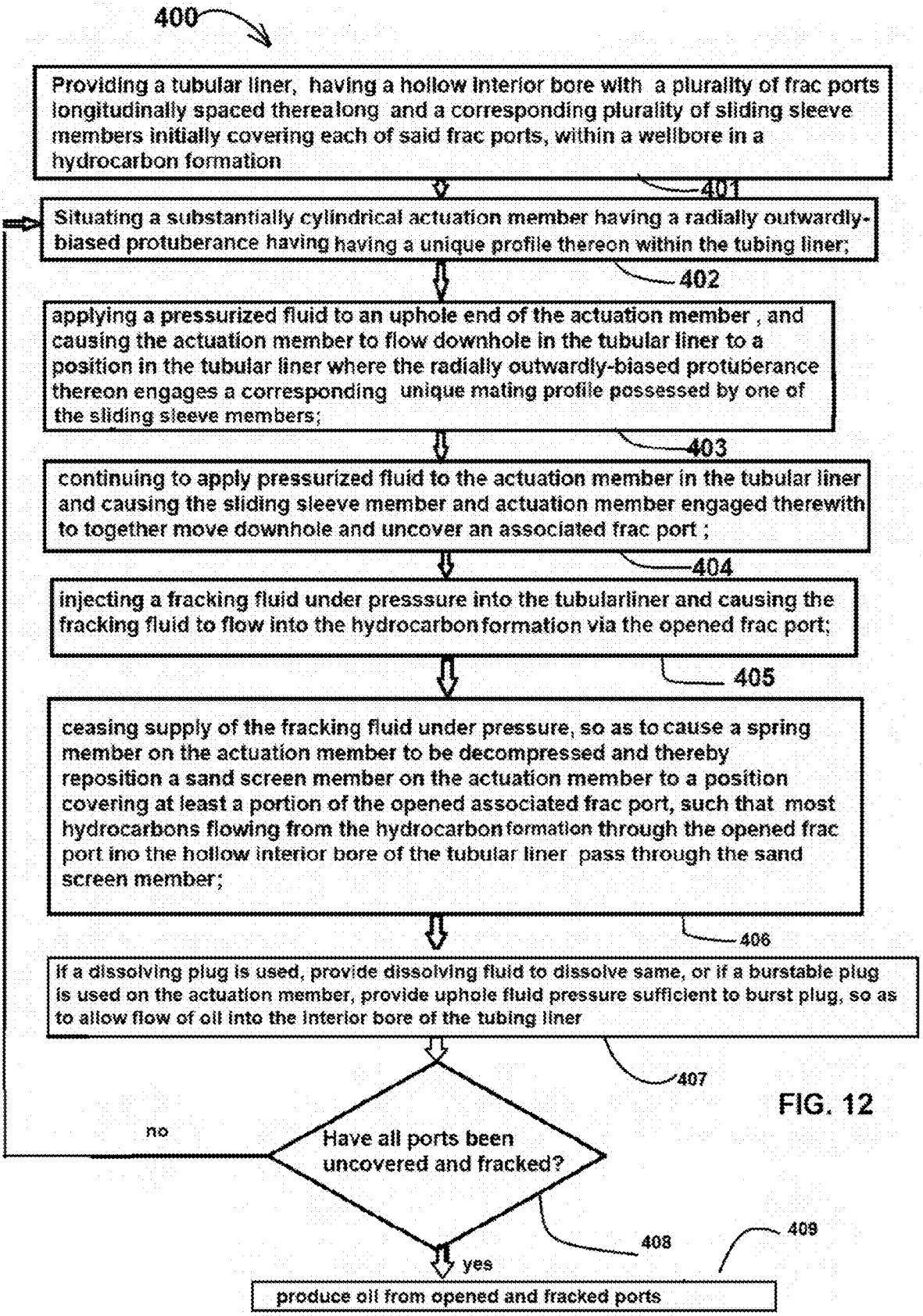
FIG. 12 is a flow diagram illustrating one broad embodiment of the method of the present invention for fracking through a selected port and thereafter automatically installing a sand screen at such port location along a tubing string, upon cessation of the fracking step.

FIG. 11 is a subsequent view of the tubing liner 14, associated port 16 and sliding sleeve 18 shown in FIG. 10 after sand 100 has flowed into the opened port 16 but not been allowed, due to the sand screen 40, to flow into the interior bore 15 of the tubing liner 14. and Operation of the Invention FIG. 12 shows a flow diagram of an embodiment of the method 400 of the present invention to frack and complete a well, using the system and apparatus of the present invention, which locates a sand screen 40 at each port 16 immediately after a fracking step at such given port 16 is completed, to prevent ingress of sand 100 into tubular liner 14 and which allows subsequent production from the formation 10 without having to first "trip out" any frac string and insert a production string/tubing liner 14 in order to commence production.

Step 401 comprises the initial step of providing a tubular liner, having a hollow interior bore 15 with a plurality of frac ports 16 longitudinally spaced therealong and a corresponding plurality of sliding sleeve members 18 covering each of said frac ports 16, within a wellbore in a hydrocarbon formation 10.

Step 402 comprises the step of situating a substantially cylindrical actuation member 25 having a radially-outwardly biased protuberance(s) 27 having a unique profile thereon within the tubing liner 14.

Step 403 comprises the step of applying a pressurized fluid to an uphole end of the actuation member 25 and causing the actuation member 25 to flow downhole in the tubing liner 14 and causing the radially outwardly-biased protuberance 27 thereon to engage a corresponding unique mating profile 22 possessed by the sliding sleeve member 25.

Step 404 comprises the step of continuing to apply pressurized fluid to the actuation member 25 in the tubular liner 14 and causing the sliding sleeve member 14 and actuation member 25 engaged therewith to together move downhole and cause the sliding sleeve 14 to uncover the associated frac port 16.

Step 405 comprises the step of injecting a fracking fluid under pressure into the tubular liner 14 and causing the fracking fluid to flow into the hydrocarbon formation 10 via the opened frac port 16.

Step 406 comprises the step of ceasing supply of the supply of fracking fluid under pressure, or reduced pressure, so as to allow a spring member 42 on the actuation member 25 to decompress and thereby reposition a sand screen member 40 on the actuation member 25 to a position covering at least a portion of the opened associated frac port 16, such that hydrocarbon flowing from the hydrocarbon formation 10 through the opened frac port 16 into the hollow interior bore 15 of the tubular liner 14 pass through the sand screen member 40.

Step 407 comprises the step, if a dissolving plug member 30 is used, providing dissolving fluid to dissolve same, or if a burstable plug 30 is used on the actuation member 25, providing uphole fluid pressure sufficient to burst the burst plug 30, so as to allow flow of oil into the interior bore 15 of the tubing liner 14.

Step 408 comprises the step of determining if all ports have been uncovered and fracked. If not, steps 401-407 are repeated, using another actuation member 25' having a unique(different) profile is utilized to open a progressively more uphole port 16, and a sand screen 40 installed in the same manner in respect of such additional port 16.

If all ports 16 have been uncovered and fracked, and sand screens 40 inserted at each successively opened port 16, then as recited in step 409, oil is thereafter produced from the completed wellbore 12.

Other permutations and combinations of the above steps in the above method will now occur to persons of skill in the art, and are contemplated herein.

The foregoing description of the disclosed embodiments of the system and methods of the present invention are provided to enable any person skilled in the art to make or use the present invention. The scope of the claims should not be limited by the preferred embodiments set forth in the examples, but should be given the broadest interpretation consistent with the specification, including the description and drawings, as a whole. Thus, the present invention is not intended to be limited to the embodiments shown herein, but is to be accorded the full scope consistent with the claims.

For a complete definition of the invention and its intended scope, reference is to be made to the summary of the invention and the appended claims read together with and considered with the disclosure and drawings herein.

We claim:

1. A method for conducting a fracking procedure at a given location along a wellbore which locates a sand screen at said given location immediately after a fracking step at such given location is completed, to prevent ingress of sand into a tubular liner and which allows subsequent production from a formation without having to first trip out any frac string prior to inserting a production string in order to commence production, comprising the steps of:

(i) locating a tubular liner having:
- a hollow interior bore;
- a plurality of frac ports longitudinally spaced along said tubular liner; and
- a corresponding plurality of sliding sleeve members initially covering corresponding each of said frac ports;

within a wellbore in a hydrocarbon formation;

(ii) situating a first substantially cylindrical actuation member having a radially outwardly-biased protuberance thereon with a unique profile within said tubular liner;

(iii) applying a pressurized fluid to an uphole end of said first actuation member having a plug member in the form of a dissolving member or a burstable disk, and causing said first actuation member to flow downhole and to a position in said tubular liner where said radially outwardly-biased protuberance thereon engages a corresponding mating profile on one of said plurality of sliding sleeve members;

(iv) continuing to apply said pressurized fluid to said first actuation member in said tubular liner and causing said one sliding sleeve member and first actuation member engaged therewith to then together move downhole and uncover and thereby open an associated of said plurality of frac ports in said tubular liner and thereby allow fluid communication from said hollow interior bore to an exterior of said tubular liner and to said hydrocarbon formation via the opened associated frac port;

(v) injecting a fracking fluid under pressure into said tubular liner and causing said fracking fluid to flow into the hydrocarbon formation via the opened frac port; and (vi) ceasing injecting of said fracking fluid under pressure, so as to cause a spring member on said first actuation member to be decompressed and thereby position a sand screen member on said first actuation member to a position covering at least a portion of said opened associated frac port such that hydrocarbons flowing from the hydrocarbon formation through said opened frac port into said hollow interior bore of said tubular liner pass through said sand screen member.

2. The method as claimed in claim 1, wherein said plug member on said actuation member is a burstable disk, further comprising the step, after step (v), of injecting a pressurized fluid into said interior bore at a pressure sufficient to rupture said burstable disk, so as to thereafter allow fluid to flow through said first actuation member.

3. The method as claimed in claim 1, wherein said plug member is a dissolvable member which dissolves after a period of time when exposed to a dissolving fluid, further comprising the step, after step (v), of injecting a dissolving fluid or using said fracking fluid if said fracking fluid is a dissolving fluid, to dissolve said dissolvable member so as to thereafter allow fluid to flow through said first actuation member.

4. The method as claimed in claim 1, further comprising the step when said first actuation member engages said one of said sliding sleeve members and moves said one sliding sleeve member within said tubular liner to said open position, causing said one of said sliding sleeve members when at said open position to lockingly engage said tubular liner, thereby retaining said one of said sliding sleeve members and associated frac port within said tubular liner in an open state.

5. The method as claimed in claim 4, wherein said step of causing said one of said sliding sleeve members when at said open position to lockingly engage said tubular liner comprises the step of causing a biased protuberance on said sliding sleeve member to engage a mating groove in said tubular member so as to retain said first sliding sleeve member in a position where the respective associated frac port is uncovered.

6. The method as claimed in claim 4 wherein said step of causing said one of said sliding sleeve members when moved to said open position to lockingly engage said tubular liner comprises the step of causing a ratchet member on said sliding sleeve to engage a mating ratchet member on said tubular liner, so as retain said one of said sliding sleeve members in a position where the respective associated frac port is uncovered.

7. The method as claimed in claim 1, wherein said step (iv) of causing said one sliding sleeve member and first actuation member engaged therewith to together move downhole and uncover and thereby open an associated of said plurality of frac ports further comprises the step using such applied pressurized fluid to cause a shear pin fixing said sliding sleeve within said tubular liner in a closed position to shear so as to then allow said one sliding sleeve member and first actuation member engaged therewith to together move downhole within said tubular liner and uncover and thereby open said associated of said plurality of frac ports.

8. The method as claimed in claim 1, further comprising the step, during step (v), of injecting the fracking fluid or another fluid under sufficient pressure to further cause a shear member longitudinally securing the sand screen to the actuation member to shear, allowing thereafter subsequent longitudinal movement of the sand screen in an uphole direction.

9. The method as claimed in claim 1, wherein when said first actuation member engages said one sliding sleeve member and moves said sliding sleeve member to said open position, causing said first actuation member to lockingly engage said sliding sleeve member, thereby preventing further movement of said actuation member relative to said one of said sliding sleeve members.

10. The method as claimed in claim 1, further comprising the step after step (vi) of:

(vii) situating a second substantially cylindrical actuation member having a resiliently outwardly-biased protuberance thereon with a unique profile, within said tubular liner;

(viii) applying a pressurized fluid to an uphole end of said second actuation member having a plug member thereon in the form of a dissolving member or a burstable disk, and causing said second actuation member to flow downhole and to a position in said tubular liner where said radially outwardly-biased protuberance thereon engages a corresponding mating profile on one of said plurality of sliding sleeve members;

(ix) continuing to apply said pressurized fluid to said first actuation member in said tubular liner and causing said one sliding sleeve member and said second actuation member engaged therewith to then together move downhole and uncover and thereby open an associated of said plurality of frac ports in said tubular liner to thereby allow fluid communication from said hollow interior bore to an exterior of said tubular liner and to said hydrocarbon formation via the opened associated frac port;

(x) injecting a fracking fluid under pressure into said tubular liner and causing said fracking fluid to flow into the hydrocarbon formation via the opened frac port; and (xi) ceasing injecting of said fracking fluid under pressure, so as to cause a spring member on said second actuation member to be decompressed and thereby position a sand screen member on said second actuation member to a position covering at least a portion of said opened associated frac port such that hydrocarbons flowing form the hydrocarbon formation through said opened frac port into said hollow interior bore of said tubular liner must pass through said sand screen member.

11. The method as claimed in claim 10, wherein said radially-outwardly biased protuberance of said first actuation member is of a width W1, and said resiliently-outwardly biased protuberance of said second actuation member is of a width W2, wherein W2<W1.

12. The method as claimed in claim 1, further comprising repeating steps (i)-(v) using second, third, and consecutive cylindrical actuating members each having a unique profile, until all of said plurality of spaced-apart ports along said tubular liner have been uncovered, the wellbore fracked at each opened frac port, and sand screen situated at each opened frac port.

* * * * *